US009703236B1

(12) United States Patent
Ichikawa

(10) Patent No.: US 9,703,236 B1
(45) Date of Patent: Jul. 11, 2017

(54) POWDER TRANSPORT MEMBER, AND POWDER TRANSPORT APPARATUS AND POWDER PROCESSING APPARATUS INCLUDING POWDER TRANSPORT MEMBER

(71) Applicant: FUJI XEROX CO., LTD., Tokyo (JP)

(72) Inventor: Yuzo Ichikawa, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/248,408

(22) Filed: Aug. 26, 2016

(30) Foreign Application Priority Data

Mar. 22, 2016 (JP) ..... 2016-057437

(51) Int. Cl.
*G03G 15/08* (2006.01)

(52) U.S. Cl.
CPC ..... *G03G 15/0891* (2013.01)

(58) Field of Classification Search
USPC ..... 399/120, 252, 256, 258, 262, 263, 358, 399/359
See application file for complete search history.

(56) References Cited

U.S. PATENT DOCUMENTS 5,285,250 A * 2/1994 Yoshioka ..... G03G 21/105 141/363
7,817,943 B2 * 10/2010 Utsumi ..... G03G 15/0872 399/254
8,064,815 B2 * 11/2011 Gibson ..... G03G 21/12 399/120
8,369,751 B2 * 2/2013 Ichikawa ..... G03G 15/0872 399/120

FOREIGN PATENT DOCUMENTS

JP H11-133827 A 5/1999
JP 2001-042623 A 2/2001
JP 2006-030334 A 2/2006

* cited by examiner

*Primary Examiner* — Hoan Tran
(74) *Attorney, Agent, or Firm* — Oliff PLC

(57) ABSTRACT

A powder transport member includes a rotation shaft, a spiral wire; and holding parts disposed near opposite ends of the rotation shaft, wherein one end portion of the spiral wire includes a terminal end circular arc portion formed in a circular arc shape, and the holding part configured to hold the one end portion of the spiral wire includes protrusions of a paired configuration at symmetrical positions with the center of the rotation shaft being interposed therebetween, a concave portion configured to accommodate an inner peripheral surface of the terminal end circular arc portion is formed at a protruding end portion of each of the protrusions, and a size of the protruding end portion of the protrusion in a direction of the rotation shaft is less than ½ of an inter-wire distance obtained by subtracting a wire diameter from a pitch of the spiral wire.

17 Claims, 27 Drawing Sheets

POWDER TRANSPORT MEMBER, AND POWDER TRANSPORT APPARATUS AND POWDER PROCESSING APPARATUS INCLUDING POWDER TRANSPORT MEMBER

CROSS-REFERENCE TO RELATED APPLICATIONS

This application is based on and claims priority under 35 USC 119 from Japanese Patent Application No. 2016-057437 filed Mar. 22, 2016.

BACKGROUND

Technical Field

The present invention relates to a powder transport member that transports powder such as toner, and a powder transport apparatus and a powder processing apparatus that use the powder transport member.

SUMMARY

According to an aspect of the invention, there is provided a powder transport member including: a rotation shaft that is rotationally driven; a spiral wire that is wound in a spiral shape in a diameter larger than an outer diameter of the rotation shaft at a predetermined pitch interval and that is formed to be insertable from one end side of the rotation shaft; and holding parts that are disposed near opposite ends of the rotation shaft respectively and that hold opposite end portions of the spiral wire in a rotation-prevented state, wherein one end portion of the spiral wire includes a terminal end circular arc portion formed in a circular arc shape, and a bent portion bent to a center side of the rotation shaft is formed at a tip end of the terminal end circular arc portion, and wherein the holding part configured to hold the one end portion of the spiral wire includes protrusions of a paired configuration at symmetrical positions with the center of the rotation shaft being interposed therebetween, a concave portion configured to accommodate an inner peripheral surface of the terminal end circular arc portion is formed at a protruding end portion of each of the protrusions, and a size of the protruding end portion of the protrusion in a direction of the rotation shaft is less than ½ of an inter-wire distance obtained by subtracting a wire diameter from a pitch of the spiral wire.

BRIEF DESCRIPTION OF THE DRAWINGS

Exemplary embodiments of the present invention will be described in detail based on the following figures, wherein:

FIGS. 1A and 1B illustrate an outline of an exemplary embodiment of a powder transport member to which the present invention is applied, in which FIG. 1A is an explanatory view illustrating a state at the time of performing an assembly operation of the powder transport member, and FIG. 1B is an explanatory view illustrating a state at the time of completing the assembly of the powder transport member;

DETAILED DESCRIPTION

Outline of Exemplary Embodiment

An example of a powder processing apparatus may include, as a basic configuration, a powder processor that performs processing using powder and a powder transport apparatus that transports an excess portion of powder processed by the powder processor or powder to be processed by the powder processor.

In the present example, the powder processor broadly includes devices that have a function for performing processing using powder. For example, an electronic photographic device may include a developing device that develops an electrostatic latent image formed on an image holding member using developer (toner) as powder. The powder transport apparatus may be built in an apparatus that collects an excess portion of powder processed by the powder processor or an apparatus that supplies powder to be processed by the powder processor.

An example of such a kind of powder processing apparatus includes a powder collector that collects an excess portion of powder processed by the powder processor, a powder transport apparatus that transports the powder collected by the powder collector, and a powder returning mechanism that returns the powder transported by the powder transport apparatus to the powder processor.

In the present example, an excess portion of powder processed by a powder processor (for example, a developing device) is collected by a powder collector (for example, a cleaner), and the powder collected by the powder collector is transported by a powder transport apparatus, and powder transported by a powder returning mechanism is returned to the powder processor.

An example of the powder transport apparatus includes a powder container that accommodates powder, a powder transport member that is disposed inside the powder container, and a driving system that rotationally drives a rotation shaft of the powder transport member. This powder transport apparatus transports powder such as toner by disposing the powder transport member inside the powder container and rotationally driving the powder transport member by the driving system.

Figure 1A:
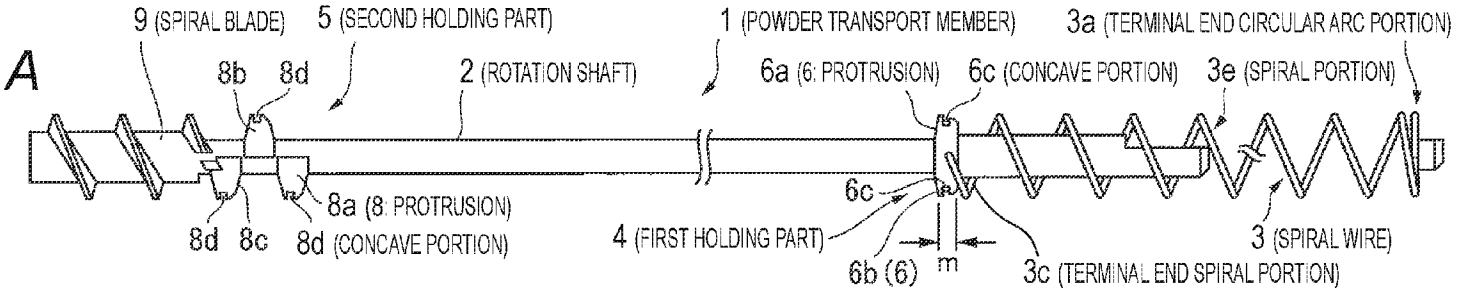

In the present exemplary embodiment, as illustrated in FIG. 1A, the powder transport member 1 includes: a rotation shaft 2 that is rotationally driven; a spiral wire 3 that is wound in a spiral shape at a predetermined pitch interval with a diameter larger than the outer diameter of the rotation shaft 2 and is formed to be capable of being inserted from one end side of the rotation shaft 2; and holding parts 4 and 5 that are disposed in the vicinity of the opposite ends of the rotation shaft 2, respectively, to hold the opposite end portions of the spiral wire 3 in a state of preventing the rotation thereof.

Here, the rotation shaft 2 may be made of either a metal or a resin, but is preferably made of a resin in consideration of moldability of the holding parts 4 and 5. In addition, the spiral wire 3 is generally made of a metal and needs to be formed to be capable of being inserted from one end of the rotation shaft 2 and, for example, an end portion on the side inserted into the rotation shaft 2 often includes a terminal end spiral portion 3*c* which is typically opened at the terminal end thereof. In addition, the holding parts 4 and 5 are disposed in the vicinity of the opposite ends of the rotation shaft, respectively, and, may basically hold the opposite end portions of the spiral wire 3 in a rotation prevention state. In addition, portions of the rotation shaft 2 located outside the holding parts 4 and 5 in the axial direction are used as portions where rotationally supported shaft portions or spiral blades are provided.

Figure 1B:
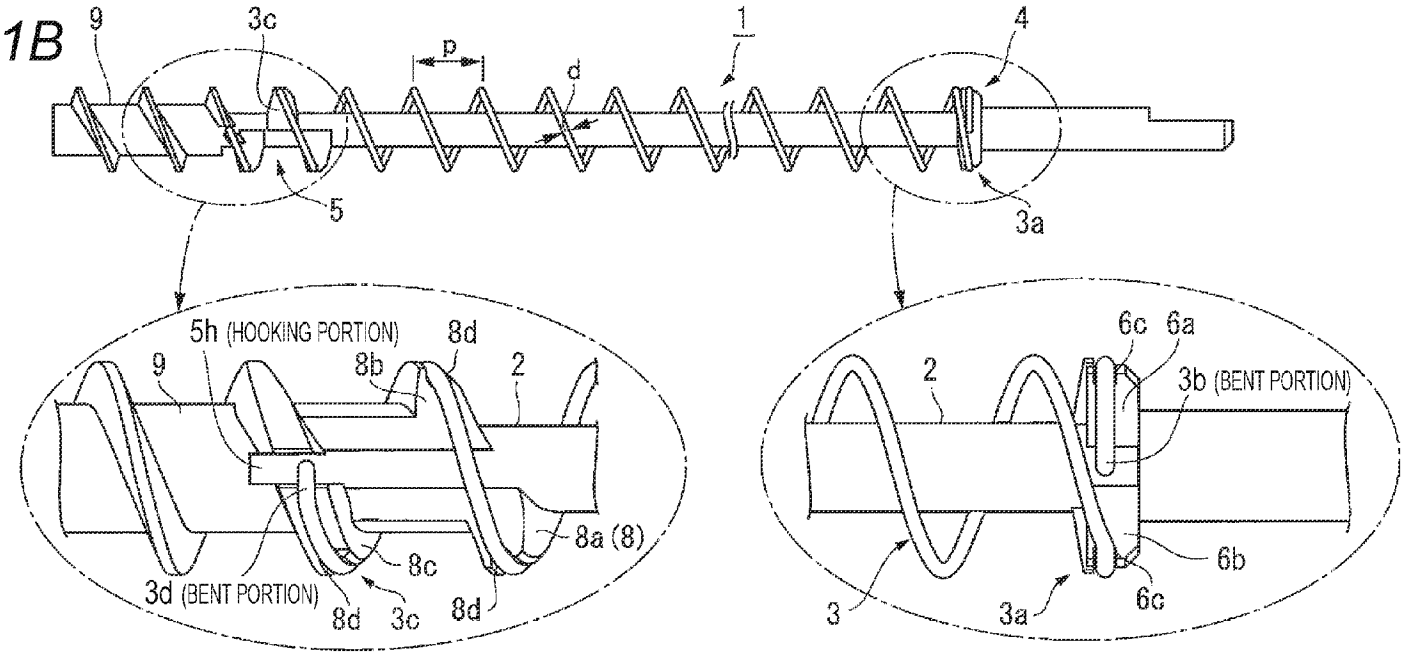

Particularly, in the present exemplary embodiment, as illustrated in FIGS. 1A and 1B, one end portion of the spiral wire 3 includes a terminal end circular arc portion 3*a* formed in a circular arc shape, and a bent portion 3*b* bent to the center side of the rotation shaft 2 is formed at the tip end of the terminal end circular arc portion 3*a*. A holding part 4 configured to holds one end portion of the spiral wire 3 (in the present example, referred to as a "first holding part") includes protrusions 6 (more specifically, 6*a*, 6*b*) of a paired configuration at symmetrical positions with the center of the rotation shaft 2 being interposed therebetween. A concave portion 6*c* is formed at a protruding end portion of each protrusion 6 to accommodate the inner circumferential face of the terminal end circular arc portion 3*a*. The size m of the protruding end portion of the protrusion 6 in the direction of the rotation shaft 2 is less than ½ of an inter-wire distance obtained by subtracting a wire diameter d from the pitch p of the spiral wire 3.

The present example focuses attention on the holding structure of one end portion of the spiral wire 3, in which, when the spiral wire 3 is inserted from one end side of the rotation shaft 2, the terminal end circular arc portion 3*a* and the bent portion 3*b* are provided on a rear end side of the spiral wire 3 inserted into the rotation shaft 2. As the first holding part 4 to hold the terminal end circular arc portion 3*a* and the bent portion 3*b*, the sizes of the protrusions 6 (6*a*, 6*b*) of a paired configuration, the concave portion 6*c*, and the protruding end portions of the protrusions 6 in the direction of the rotation shaft 2 are conceived, and when the spiral wire 3 is inserted into the rotation shaft 2, it is not interrupted by the first holding part 4, and, when the insertion is completed, the end portion of the spiral wire 3 on the rear end side of the rotation shaft 2 is held in a state in which rotation is prevented.

Next, a typical form or a preferable form of the powder transport member 1 according to the present exemplary embodiment will be described.

First, the terminal end circular arc portion 3*a* of the spiral wire 3 typically has an inner diameter which is the same as the inner diameter of the spiral portion 3*e* of the spiral wire 3. In some cases, the terminal end circular arc portion 3*a* may have an inner diameter different from the inner diameter of the spiral portion 3*e* of the spiral wire 3. However, in consideration of the holding operation toward the holding part 4, the terminal end circular arc portion 3*a* may be configured to have the same inner diameter as the inner diameter of the spiral portion 3*e*. Here, in a case where the inner diameter of the terminal end circular arc portion 3*c* is configured to be large, the size of the protrusion 6 of the first holding part 4 needs to be set to be large in accordance therewith, and accordingly, there is concern that the first holding part 4 becomes an obstacle when the spiral wire 3 is inserted from one end of the rotation shaft 2. On the other hand, in a case where the inner diameter of the terminal end circular arc portion 3*a* is configured to be small, the protrusion size of the protrusion 6 of the first holding part 4 may be small. However, in such a case, there is concern that an operation force is required when the terminal end circular arc portion 3*a* is held in the first holding part 4 (the concave portion 6*c* of the protrusion 6).

In addition, as an aspect of the first holding part 4, there may be an aspect in which the concave portion 6*c* of the protrusion 6 may have a depth size of ½ or more of the wire diameter d of the spiral wire 3. In the present example, since a half or more of the terminal end circular arc portion 3*a* may be accommodated in the concave portion 6*c*, the terminal end circular arc portion 3*a* hardly comes out from the concave portion 6*c*.

Furthermore, as an aspect of the first holding part 4, there may be an aspect in which the protruding end portion of the protrusion 6 may include a stepped portion which has lower height at the entrance side from which the terminal end circular arc portion 3*a* is entered toward the concave portion 6*c* than that at the opposite side. In the present example, the terminal end circular arc portion 3*a* may be easily entered toward the concave portion 6*c*, compared to an aspect that does not have the stepped portion.

In addition, as a preferable form of the first holding part 4, there may be an aspect in which the protruding end portion of the protrusion 6 may include an inclined portion that is inclined such that the protrusion size of the protruding end portion is gradually increased toward the concave portion 6*c* at the entrance side from which the terminal end circular arc portion 3*a* is entered toward the concave portion 6*c*. In the present example, the terminal end circular arc portion 3*a* is entered into the concave portion 6*c* by being guided by the inclined portion, and accordingly, the terminal end circular arc portion 3*a* may be easily entered into (toward) the concave portion 6*c*.

In addition, in a rotation prevention structure of the first holding part 4, the bent portion 3*b* of the terminal end circular arc portion 3*a* is disposed in contact with or in proximity to one of the protrusions 6 (6*a* or 6*b*) when the rotation shaft 2 is driven to rotate. In the pre example, when the rotation shaft 2 is driven to rotate, the bent portion 3*b* of the terminal end circular arc portion 3*a* is disposed in contact with or in proximity to one protrusion 6*a* or 6*b* so as to be stopped.

In addition, as a rotation prevention structure of the first holding part 4, there may be an aspect in which a hooking portion (not illustrated) may be formed in a portion located between the protrusions 6 (6*a*, 6*b*) in the circumference direction of the rotation shaft 2 to cause the bent portion 3*b* of the terminal end circular arc portion 3*a* to be hooked in the hooking portion. The present example is an aspect in which the hooking portion is included in the vicinity of the first holding part 4 of the rotation shaft 2, and, when the rotation shaft 2 is driven to rotate, the bent portion 3*b* of the terminal end circular arc portion 3*a* is hooked in the hooking portion without accompanying idling.

As a holding structure of the other end portion of the spiral wire 3, there may be an aspect in which the other end portion of the spiral wire 3 may include a terminal end spiral portion 3*c* having an opened terminal end, and a bent portion 3*d* bent to the center side of the rotation shaft 2 is formed at the terminal end of the terminal end spiral portion 3*c*. A holding part 5 (in the present example, referred to as a second holding part) configured to hold the other end portion of the spiral wire 3 includes three protrusions 8 (more specifically, 8*a* to 8*c*) at an interval of half circumference of the rotation shaft 2 and at an interval of the pitch p of the spiral wire 3, a concave portion 8*d* capable of accommodating the inner peripheral surface of the terminal end spiral portion 3*c* is formed at a protruding end portion of each protrusion 8, and a hooking portion 5*h* in which the bent portion 3*d* of the terminal end spiral portion 3*c* may be hooked is formed on the rotation shaft 2.

The present example is an aspect in which, in the other end portion of the spiral wire 3, the bent portion 3*d* is formed at the terminal end of the terminal end spiral portion 3*c*. The terminal end spiral portion 3*c* is held at an interval of half circumference of the rotation shaft 2 at three points, and the rotation is prevented by the bent portion 3*d* of the terminal end spiral portion 3*c* and the hooking portion 5*h*. At this time, since the terminal end spiral portion 3*c* is held in the three protrusions 8 (8*a* to 8*c*) as the second holding part 5 without changing the pitch p of the spiral wire 3, the outer diameter of the spiral wire 3 is not changed, and there is no concern that frictional heat is generated between a transport path and the peripheral wall. In addition, while the terminal end spiral portion 3*c* is held in the concave portions 8*d* of the three protrusions 8 at an interval of half circumference of the rotation shaft 2, reaction forces applied to the terminal end spiral portion 3*c* from the concave portions 8*d* act only in directions of cancelling each other so that there is no concern that a moment is generated with respect to the spiral direction or the direction of the rotation shaft in the terminal end spiral portion 3*c*. For this reason, even if a moment is generated, the terminal end spiral portion 3*c* does not come out from the rotation shaft 2.

As a preferable form of the second holding part 5, there may be an aspect in which the concave portions 8*d* of the three protrusions 8 (8*a* to 8*c*) have a depth size of ½ or more of the wire diameter d of the spiral wire 3. In the present example, since a half or more of the terminal end spiral portion 3*c* is accommodated in the concave portions 8*d* of the three protrusions 8 (8*a* to 8*c*), the terminal end spiral portion 3*c* hardly comes out from the concave portions 8*d* even if the rotation shaft 2 rotates. Of course, each of the protrusions 8 (8*a* to 8*c*) may be provided with a stepped portion or an inclined portion, similar to the first holding part 4.

As a typical aspect of the powder transport member 1, there may be an aspect in which the rotation shaft 2 and the holding parts 4 and 5 are integrally molded from a resin, and the spiral wire is formed of a metal. The present example provides a powder transport member which is excellent in assemblability and transport property by integrally molding the rotation shaft 2 and the holding parts 4 and 5 of a resin, and combining them with the spiral wire 3 made of a metal.

As an aspect of the powder transport member 1, there may be an aspect in which the rotation shaft 2 includes a spiral blade 9 made of a resin at a portion adjacent to the second holding part 5 holding the other end portion of the spiral wire 3. In the present example, since the rotation shaft 2 includes the resin-made spiral blade 9 leading to the metal-made spiral wire 3, the powder transport member 1 of the present example is capable of continuously transporting powder from the spiral wire 3 toward the spiral blade 9.

In addition, as a rotation prevention structure of the spiral wire 3 in the aspect in which the spiral wire 3 has the resin-made spiral blade 9, a groove may be formed in the resin-made spiral blade 9 as the hooking portion 5*h* in which the bent portion 3*d* of the terminal end spiral portion 3*c* may be hooked. In the present example, it is possible to prevent the terminal end spiral portion 3*c* by forming a groove as the hooking portion 5*h* in a part of the spiral blade 9 and hooking the bent portion 3*d* of the spiral portion 3*c* therein. At this time, when the groove portion is widely secured in length in longitudinal direction of the rotation shaft 2 as the hooking portion 5*h*, the terminal end spiral portion 3*c* is hooked in the groove even if the tip end bending shape of the terminal end spiral portion 3*c* is changed to be bent in the longitudinal direction of the rotation shaft 2. Thus, this is desirable in that the rotation prevention effect becomes more stable. In addition, since the powder transport face is a downstream side face of the spiral blade 9, the powder is preferably widened toward the upstream side such that the transport is not obstructed.

In addition, as a typical aspect for driving the powder transport member 1 to rotate, there may be an aspect in which a drive transmission member (not illustrated) configured to transmit a drive force is mounted on an end portion of the rotation shaft 2 at the side of the first holding part 4 configured to hold one end portion of the spiral wire 3. The present example is an aspect in which the rotation shaft 2 is driven to rotate through the drive transmission member, and the spiral wire 3 held on the rotation shaft 2 is rotated following the rotation.

As an aspect of the powder transport member 1 to which the drive transmission member of such a kind is attached, there may be a form in which the rotation shaft 2 includes a gripping protrusion (not illustrated) that has a diameter smaller than that of the holding part 4 and is arranged not to be in contact with the spiral wire 3 in addition to the protrusions 6 (6*a*, 6*b*) of a paired configuration as the first holding part 4 configured to hold one end portion of the spiral wire 3.

The present example enables, when mounting the drive transmission member on the powder transport member 1, an operator to fix the powder transport member 1 in a state in which the gripping protrusion of the powder transport member 1 is gripped, and to mount the drive transmission member on the end portion of the rotation shaft 2 of the powder transport member 1 in this state. At this time, when the spiral wire 3 is inserted from one end of the rotation shaft 2, the insertion operation of the spiral wire 3 shall not be obstructed by the gripping protrusion, and it is desirable that the gripping protrusion is disposed at an interval of an integral multiple of the pitch p of the spiral wire 3 from the protrusions 6 (6*a*, 6*b*) of a paired configuration as the first holding part 4.

Exemplary Embodiment 1

Hereinafter, exemplary embodiments of the present invention illustrated in the accompanying drawings will be described in detail.

Whole Configuration of Image Forming Apparatus

Figure 2:
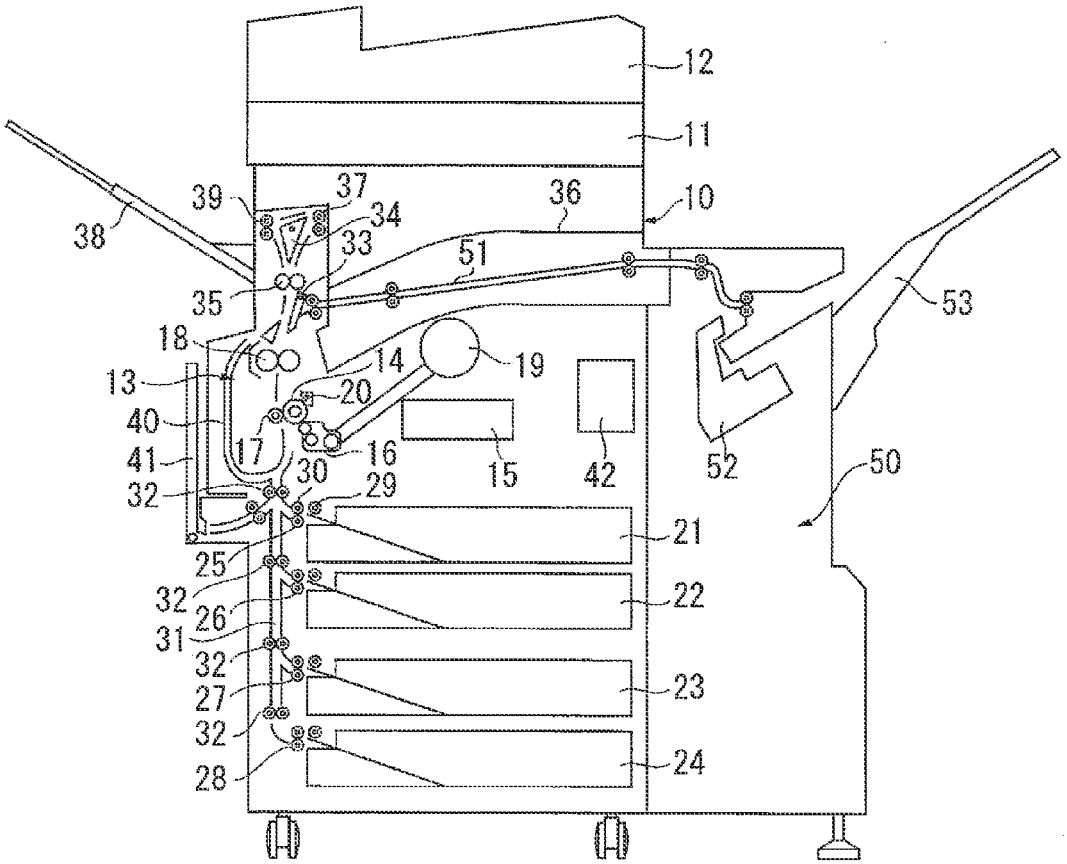
FIG. 2 is an explanatory view illustrating the whole configuration of an image forming apparatus according to Exemplary Embodiment 1.

FIG. 2 is a view schematically illustrating a configuration of an image forming apparatus according to the present exemplary embodiment. Here, a state is illustrated which is obtained by viewing the inside of the apparatus from the front side.

The image forming apparatus illustrated in the drawing includes: an image forming apparatus body 10 that forms an image using electronic photography; a document reading device 11 that reads a document; and an automatic document feeding device 12 that transports the document up to a reading position of the document reading device 11. The image forming apparatus body 10 forms a toner image using an image forming section 13 by using image data output from the document reading device 11 or image data output from a PC or the like (not illustrated), transfers the toner image onto a sheet (recording material) and then fixes the toner image, thereby outputting a print image.

In the present example, the image forming section 13 includes: a drum-shaped photoreceptor body 14 to hold a toner image; an exposure unit 15 such as a laser scanning device that exposes the electrically-charged photoreceptor body 14; a developing device 16 that develops an electrostatic latent image is formed on the photoreceptor body 14 by being exposed by the exposure unit 15; a transfer unit (in the present example, a transfer roll type) 17 that transfers the toner image developed by the developing device 16 and held on the photoreceptor body 14 onto a sheet; a fixing unit 18 that fixes the toner image transferred by the transfer unit 17 to a sheet; and a cleaner 20 that eliminates and collects toner remaining on the photoreceptor body 14.

Here, the toner used by the developing device 16 is supplied from a toner supply bottle 19 to the developing device 16. In the present exemplary embodiment, residual toner remaining on the photoreceptor body 14 after the transfer of the toner image to a sheet is eliminated and collected by the cleaner 20, and the residual toner eliminated and collected is supplied to the developing device 16 again.

In addition, the image forming apparatus body 10 includes a series of sheet transport systems, and includes sheet storage containers 21, 22, 23, and 24 that store sheets within the lower side thereof. Such sheet storage containers 21, 22, 23, and 24 are provided with sheet supply mechanisms 25, 26, 27, and 28, respectively, and sheets are output from the inside of the sheet storage containers 21, 22, 23, and 24 to the sheet transport path 31.

The sheet transport path 31 is provided with: a transport roller 32 disposed near the sheet supplying mechanisms 25 to 28; switching gates 33 and 34 that switch the transport direction of sheets near an exit unit of the image forming apparatus body 10; a transport roller 35 disposed between the switching gates 33 and 34; a discharge roller 37 that discharges sheets to a sheet discharge receiver 36 in a face-down state (a state in which a recording face is faced downward); and a discharger roller 39 that discharges sheets to a sheet discharge receiver 38 in a face-up state (a state in which a recording face is faced upward). In addition, in a case where double-sided recording is performed for a sheet, a sheet reversing transport path 40 used for reversing the sheet recorded on one side and transmitting the sheet to a transfer section (a section in which the photoreceptor body 14 and the transfer unit 17 contact with each other) is provided. In addition, on a side face of the image forming apparatus body 10, for example, an openable/closable manual tray 41 configured to supply sheets of a size or a type that are not stored in the sheet storage containers 21 to 24 of the four stages is provided. Furthermore, the image forming apparatus body 10 includes a control unit 42 that controls the overall apparatus in relation to sheet transport, image formation, and the like.

The image forming apparatus body 10 is connected to a post-processing device 50. The post-processing device 50 includes a stapler 52 that performs staple binding of a sheet bundle obtained by binding sheets discharged from a post-processing transport path 51 and a vertically movable sheet storage receiver 53 that receives the staple-bound sheet bundle.

Here, an image forming process performed in the image forming apparatus body 10 will be described.

In the photoreceptor body 14 of the image forming section 13, after the surface is electrically charged by an electric charger (not illustrated), the surface is exposed by the exposure unit 15 based on input image data so that an electrostatic latent image is formed thereon. Meanwhile, toner is supplied to the developing device 16 from the toner supply bottle 19, and developer is stirred within the developing device 16. The electrostatic latent image formed on the photoreceptor body 14 is developed using toner within the developing device 16 so that a toner image is formed on the photoreceptor body 14. The formed toner image is transferred onto a sheet in the transfer section in which the transfer unit 17 contacts with the photoreceptor body 14, and the transferred toner image is heated and fixed by the fixing unit 18 to be output. Meanwhile, toner (residual toner) remaining on the photoreceptor body 14 after the transfer is eliminated and collected from the photoreceptor body 14 by the cleaner 20.

<Developing Device and Cleaner>

Figure 3:
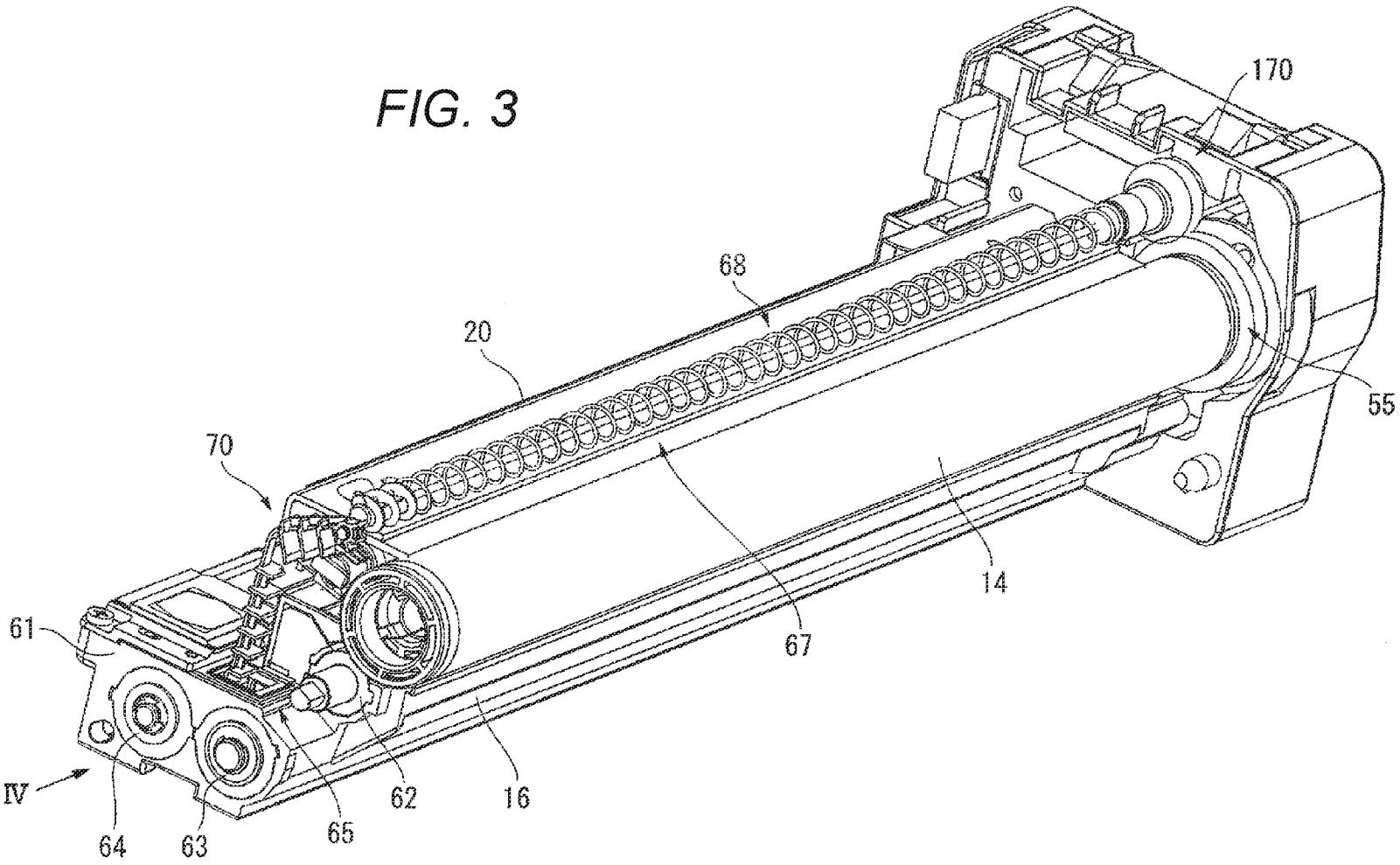
FIG. 3 is an explanatory view illustrating a developing device, a cleaner, and a toner returning mechanism used in Exemplary Embodiment 1.

In addition, in the present exemplary embodiment, as illustrated in FIG. 3, the developing device 16 is provided below the cleaner 20, and includes a developing container 61 opened in a portion facing the photoreceptor body 14 to receive developer (for example, two-component developer containing toner and a carrier). A developing roller 6, to which developer is transported, is arranged in a portion facing the opening of the developing container 61, and stirring and transport members 63 and 64 of a paired configuration is arranged inside the developing container 61 to stir and transport the developer contained in the developing container 61. In addition, a new toner supply port (not illustrated) configured to supply new toner from the toner supply bottle 19 and a re-use toner supply port 65 configured to reuse toner collected by the cleaner 20 are arranged in the developing container 61. The re-use toner supply port 65 is disposed near the stirring and transport member 63 at a side close to the developing roller 62, and the new toner supply port is disposed near the stirring and transport member 64 at a side far from the developing roller 62.

Meanwhile, as illustrated in FIG. 3, the cleaner 20 includes a cleaning container 66 opened in a portion facing the photoreceptor body 14 to receive residual toner on the photoreceptor body 14. On the edge of the opening of the cleaning container 66, a cleaning blade 67 is arranged to scrape and clean the residual toner on the photoreceptor body 14 is arranged, and, inside the cleaning container 66, a toner transport member 68 extending along the axial direction of the photoreceptor body 14 is arranged to transport the residual toner received within the cleaning container 66 along the axial direction of the photoreceptor body 14. In addition, a toner discharge port 69 is arranged at the downstream end of the cleaning container 66 in the toner transport direction according to the toner transport member 68.

In FIG. 3, reference numeral 55 indicates a driving gear that drives the photoreceptor body 14.

Toner Returning Mechanism

Between the toner discharge port 69 (see FIG. 4) of the cleaner 20 and the re-use toner supply port 65 of the developing device 16, a toner returning mechanism 70 is provided.

Figure 4:
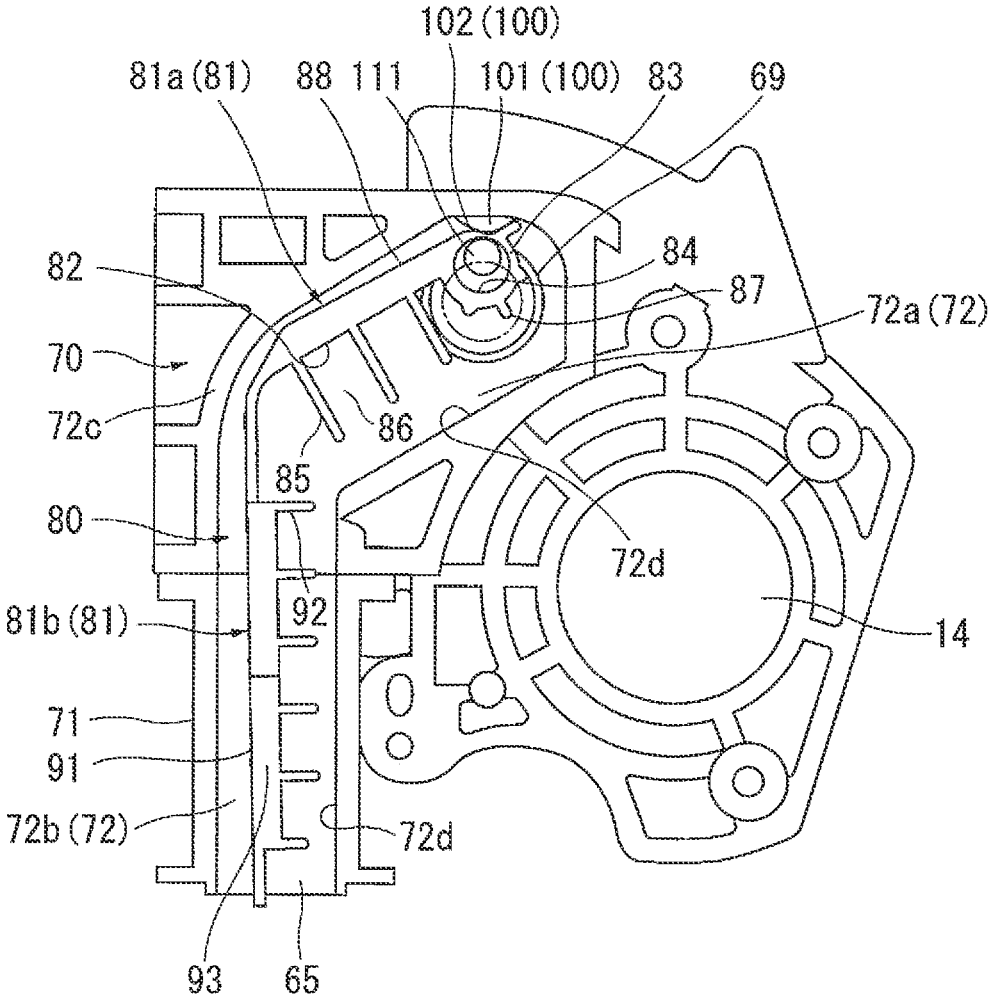
FIG. 4 is a view illustrating the toner returning mechanism when viewed in a direction IV in FIG. 3.
Figure 5:
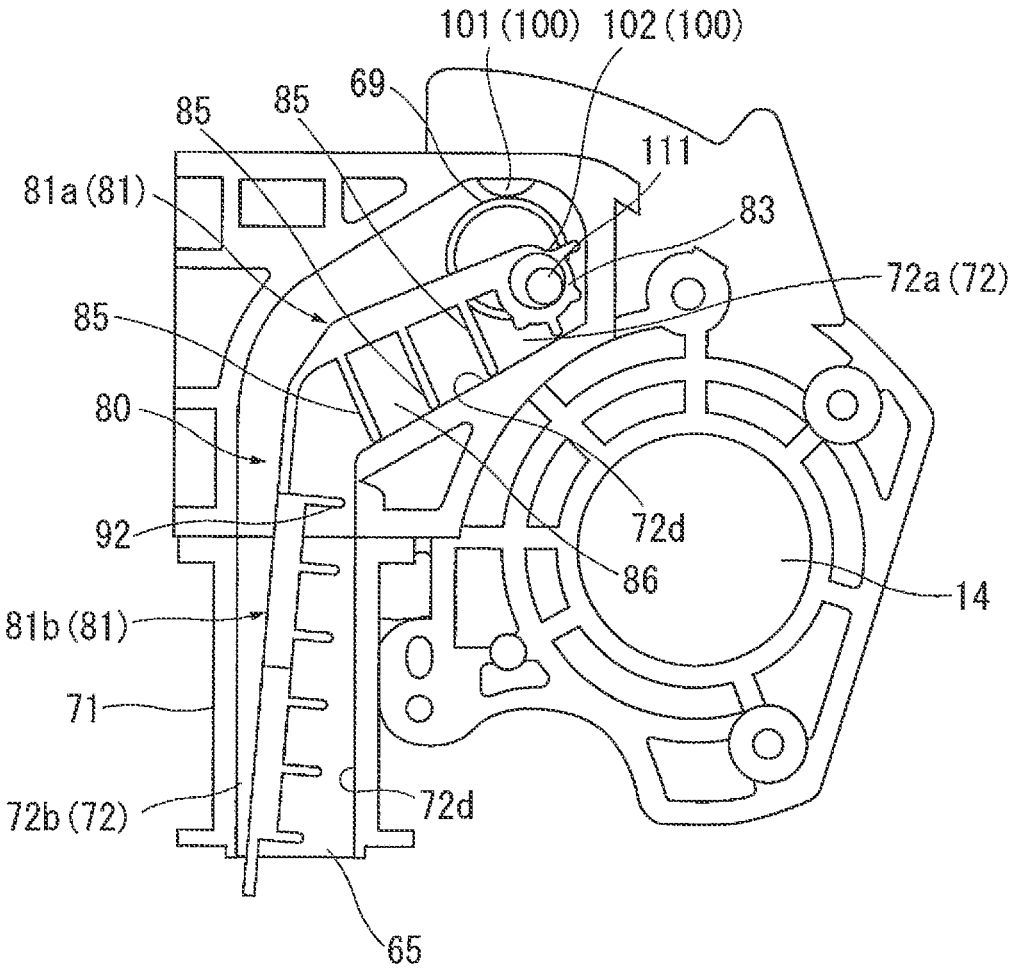
FIG. 5 is an explanatory view illustrating a toner returning operation principle by the toner returning mechanism illustrated in FIG. 4.

As illustrated in FIGS. 3 to 5, the toner returning mechanism 70 includes a duct member 71 that interconnects the toner discharge port 69 of the cleaner 20 and the re-use toner supply port 65 of the developing device 16 to communicate with each other, a returning transport path 72 formed inside the duct member 71 to transport toner collected by the cleaner 20 to the developing device 16, and a forcible transport mechanism 80 arranged inside the returning transport path 72.

Here, the returning transport path 72 will be described in detail. In the returning transport path 72, a horizontal transport path 72*a* inclined obliquely downward from the position of the toner discharge port 69 of the cleaner 20 and a vertical transport path 72*b* extending from the re-use toner supply port 65 of the developing device 16 in a substantially vertical direction (longitudinal direction) communicate with each other via a smooth bent portion 72*c*. The lower face of the horizontal transport path 72*a* and one side face of the vertical transport path 72*b* that is continuous from the lower face are configured as a toner transport face 72*d*.

In addition, the forcible transport mechanism 80 includes a transport member 81 that moves along the returning transport path 72.

The transport member 81 is constituted with a horizontal transport member 81*a* that reciprocates along the horizontal transport path 72*a* of the returning transport path 72, and a vertical transport member 81*b* that extends at the downstream side of the horizontal transport member 81*a* in the toner transport direction in an substantially vertical direction to be integrally formed with the horizontal transport member 81*a*. The vertical transport member 81*b* is arranged inside the vertical transport path 72*b*.

Here, the shape of the transport member 81 (the horizontal transport member 81*a* and the vertical transport member 81*b*) will be described below.

First, the horizontal transport member 81*a* is molded using, for example, a resin material such as PP, ABS, or POM, and includes a plate-shaped base material 82 that extends along the toner transport direction of the horizontal transport path 72*a*. At the upstream end of the plate-shaped base material 82 in the toner transport direction, a circular ring portion 83 as a driving input unit having a circular hole 84 is disposed. In addition, on the lower side of the plate-shaped base material 82, plural blade members 85 protruding to the toner transport face 72*d* side of the horizontal transport path 72*a* are arranged at the interval of a predetermined pitch, and concave portions 86 of a predetermined partitioned area are secured among the respective blade members 85.

In particular, in the present exemplary embodiment, the tip end portion of each blade member 85 is configured as a sharp protrusion and thus, pierces toner staying on the toner transport face 72*d* by the weight of the horizontal transport member 81*a* so that the effect of scraping the toner may be improved.

In addition, in the horizontal transport member 81*a*, plural auxiliary blade members 87 extending radially are arranged at an appropriate interval on the periphery of the circular ring portion 83 as well. All or some of the blade members 85 also protrude to the upper side of the plate-shaped base material 82 and are cross-linked with a guide rib 88 that is arranged to be orthogonal to the plate-shaped base material 82.

In addition, the vertical transport member 81*b* is molded integrally with the horizontal transport member 81*a* to form an obtuse angle with respect to the horizontal transport member 81*a*, and includes a long plate-shaped base material 91 of which the lower end portion extends up to the inside of the re-use toner supply port 65 of the developing device 16. On one side of the plate-shaped base material 91, plural blade members 92 protruding to the toner transport face 72*d* side of the vertical transport path 72*b* are arranged at an appropriate interval. In addition, reference numeral 93 indicates a reinforcing rib orthogonally arranged between the plate-shaped base material 91 and the blade members 92. Furthermore, when the blade members 92 are also provided with a sharp protrusion, the toner scraping effect may be improved.

In the present exemplary embodiment, as illustrated in FIGS. 4 to 7, the circular ring portion 83 of the horizontal transport member 81*a* is attached to the end portion of the rotation shaft 110 of the toner transport member 68. In this attachment, an eccentric pin 111 is configured to protrude at an eccentric position from the center of the rotation shaft 110 of the toner transport member 68 and the eccentric pin 111 is fitted into the hole 84 of the circular ring portion 83 of the eccentric pin 111 with a margin such that the circular ring portion 83 of the horizontal transport member 81*a* is rotated through the eccentric pin 111 in a substantially circular trace or an oval vertically flat trace. At this time, since the attachment position of the horizontal transport member 81*a* with respect to the rotation shaft 110 of the toner transport member 68 of the cleaner 20 is eccentric with respect to the rotation shaft 110, the circular ring portion 83 of the horizontal transport member 81*a* is in the state of a so-called cam connection with respect to the rotation shaft 110 of the toner transport member 68.

In the exemplary embodiment, a guide mechanism 100 is provided between the horizontal transport path 72*a* and the horizontal transport member 81*a*. This guide mechanism 100 includes a guide convex portion 101 protruding in a sectional circular arc shape on the upper face located on the upstream side of the horizontal transport path 72*a* in the toner transport direction, and the guide convex portion 101 contacts with the guide rib 88 of the horizontal transport member 81*a*, and the posture of the horizontal transport member 81*a* is changed at the time of the returning movement of the horizontal transport member 81*a*.

In addition, in this guide mechanism 100, a guide concave portion 102 into which the guide convex portion 101 is fitted is disposed on the upstream side of the guide rib 88 of the horizontal transport member 81*a* in the toner transport direction is disposed, and, in a state in which the guide convex portion 101 and the guide concave portion 103 are engaged with each other, the horizontal transport member 81*a* and the vertical transport member 81*b* are arranged to be separate from each other with respect to the toner transport face 72*d* of the returning transport path 72.

In addition, in the present exemplary embodiment, the guide convex portion 101 that is the guide mechanism 100 is arranged above the toner discharge port 69 of the cleaner 20, and it is considered that the operation of discharging toner from the toner discharge port 69 is not blocked by the guide convex portion 101.

Next, the operation of the toner returning mechanism 70 will be described with reference to FIGS. 4 and 5.

Now, it is assumed that the rotation shaft 110 of the toner transport member 68 of the cleaner 20 rotates, and the eccentric pin 111 is located at a position illustrated in FIG. 4.

At this time, since the guide convex portion 101 of the guide mechanism 100 is in the state of being engaged with the guide concave portion 102 of the horizontal transport member 81*a*, both of the horizontal transport member 81*a* and the vertical transport member 81*b* are arranged to be spaced apart the toner transport faces 72*d* of the corresponding transport paths 72*a* and 72*b*.

Thereafter, when the rotation shaft 110 of the toner transport member 68 rotates, and the eccentric pin 111 moves to the center circumference of the rotation shaft 110, the position of the circular ring portion 83 of the horizontal transport member 81*a* is lowered in accordance with the movement of the eccentric pin 111, and accordingly, in accordance therewith, the horizontal transport member 81*a* is moved to the lower side.

In this state, in accordance with the movement of the horizontal transport member 81*a*, the guide convex portion 101 of the guide mechanism 100 is separated from the guide concave portion 102 of the horizontal transport member 81*a* so that the engagement therebetween is released. Then, the transport member 81 tilts according to a weight balance by using a contact point with the guide convex portion 101 as a fulcrum, and for example, the blade members 92 of the vertical transport member 81*b* are brought into contact with the toner transport face 72*d* of the vertical transport path 72*b*.

Thereafter, when the eccentric pin 111 further rotates, the auxiliary blade member 87 of the horizontal transport member 81*a* moves in a contacting state along the upstream-side inner wall face of the horizontal transport path 72*a* in accordance with the rotary movement of the eccentric pin 111. Accordingly, toner attached to the upstream-side inner wall face of the horizontal transport path 72*a* is effectively scraped.

In addition, when the eccentric pin 111 rotates, as illustrated in FIG. 5, the blade member 85 of the horizontal transport member 81*a* is brought into contact with the toner transport face 72*d* of the horizontal transport path 72*a*, and the blade member 85 of the horizontal transport member 81*a* linearly moves along the toner transport face 72*d*. As a result, the blade member 85 transports toner disposed on the toner transport face 72*d* along the toner transport face 72*d*.

In particular, in the present exemplary embodiment, since the toner collected by the cleaner 20 is sequentially transported to the developing device 16 for each of the volumes of the concave portions 86 of the horizontal transport member 81*a*, the amount of supply of toner to the developing device 16 may be almost constant, and a large amount of toner is prevented from being supplied to the developing device 16 at once.

Meanwhile, the blade members 92 of the vertical transport member 81*b* start to be separated from the toner transport face 72*d* of the vertical transport path 72*b*. For this reason, when the toner transported by the horizontal transport member 81*a* arrives from the horizontal transport path 72*a* to the vertical transport path 72*b*, the toner moves to the lower side through a secured transport space without disturbing a gravity fall along the toner transport face 72*d* of the vertical transport path 72*b*.

Subsequently, when the rotation shaft 110 of the toner transport member 68 further rotates and the eccentric pin 111 rotates in accordance therewith, the blade member 85 located at the downstream side of the horizontal transport member 81*a* comes out from the toner transport face 72*d* of the horizontal transport path 72*a*. Then, the transport member 81 tilts according to a weight balance by using the second blade member 85 as a fulcrum, and the vertical transport member 81*b* moves to the toner transport face 72*d* side of the vertical transport path 72*b* like a pendulum to contact with the toner transport face 72*d*, and the posture of the vertical transport member 81*b* is regulated.

Thereafter, when the rotation shaft 110 of the toner transport member 68 further rotates and the eccentric pin 111 is rotated in accordance therewith, the horizontal transport member 81*a* moves to the upper side, and the vertical transport member 81*b* is moved up in accordance therewith.

In addition, when the rotation shaft 110 of the toner transport member 68 rotates and the eccentric pin 111 is rotated in accordance therewith, the guide rib 88 of the horizontal transport member 81*a* is brought into contact with the guide convex portion 101, which has a sectional circular arc shape, of the guide mechanism 100, and the posture of the horizontal transport member 81*a* starts to be adjusted in accordance therewith. By being interlocked therewith, the posture of the vertical transport member 81*b* also starts to be adjusted.

Thereafter, when the eccentric pin 111 further rotates and arrives at the position illustrated in FIG. 4 again, the guide convex portion 101 of the guide mechanism 100 is engaged with the guide concave portion 102 of the horizontal transport member 81*a*, and the posture of the transport member 81 is adjusted to a predetermined reference posture (in the present example, a posture in which the blade members 85 and 92 of the transport members 81*a* and 81*b* are spaced apart from the toner transport faces 72*d* of the transport paths 72*a* and 72*b*).

Thereafter, in accordance with the rotation of the rotation shaft 110 of the toner transport member 68, the same toner returning operation process is repeated, and the toner collected by the cleaner 20 is returned to the developing device 16 through the toner returning mechanism 70.

Toner Transport Member of Cleaner

Figure 6A:
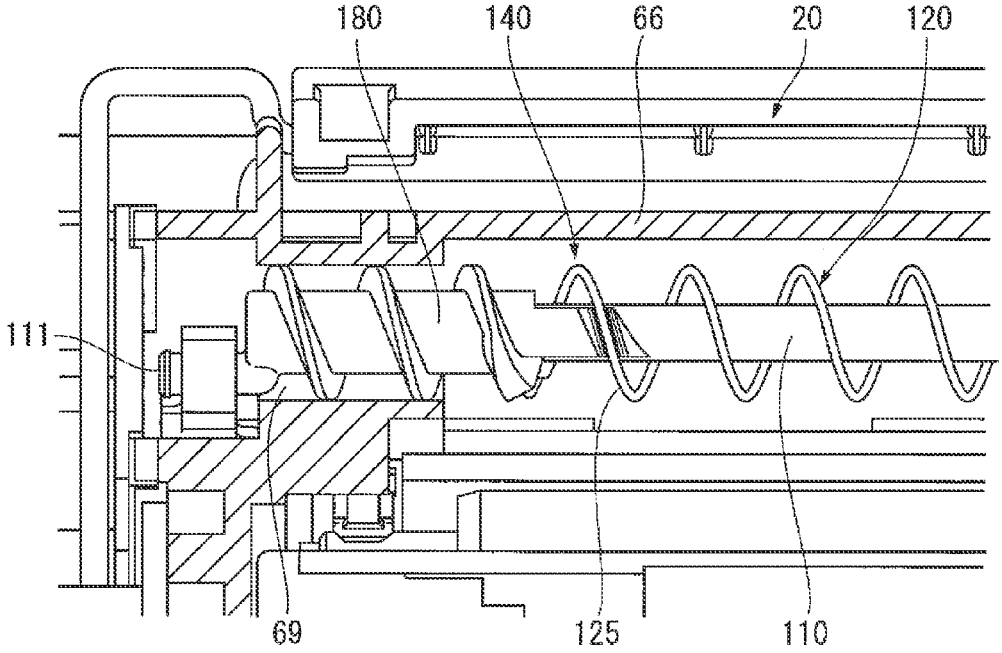
FIG. 6A is an explanatory view illustrating a support structure of one side of a toner transport member of the cleaner.
Figure 6B:
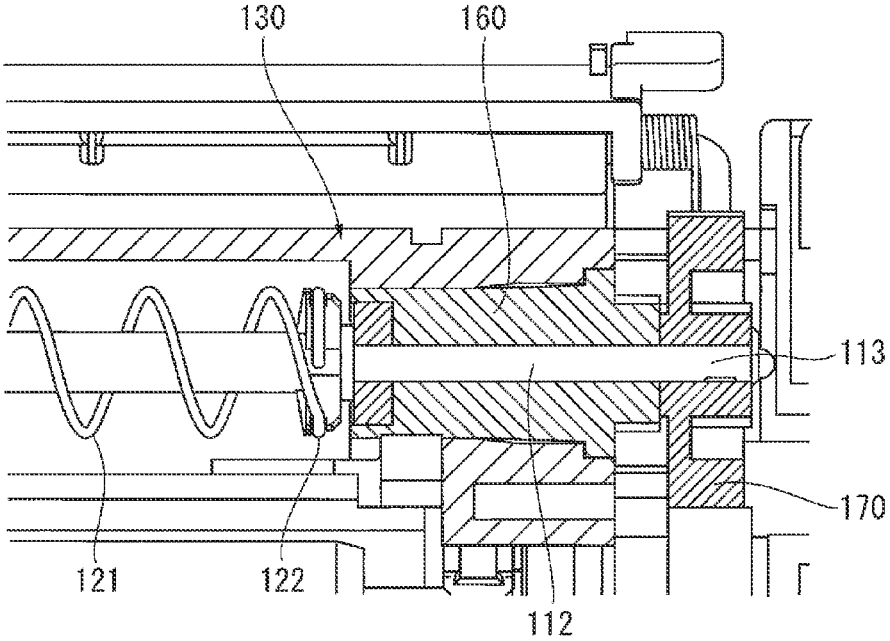
FIG. 6B is an explanatory view illustrating a support structure of the other side of the toner transport member.
Figure 7:
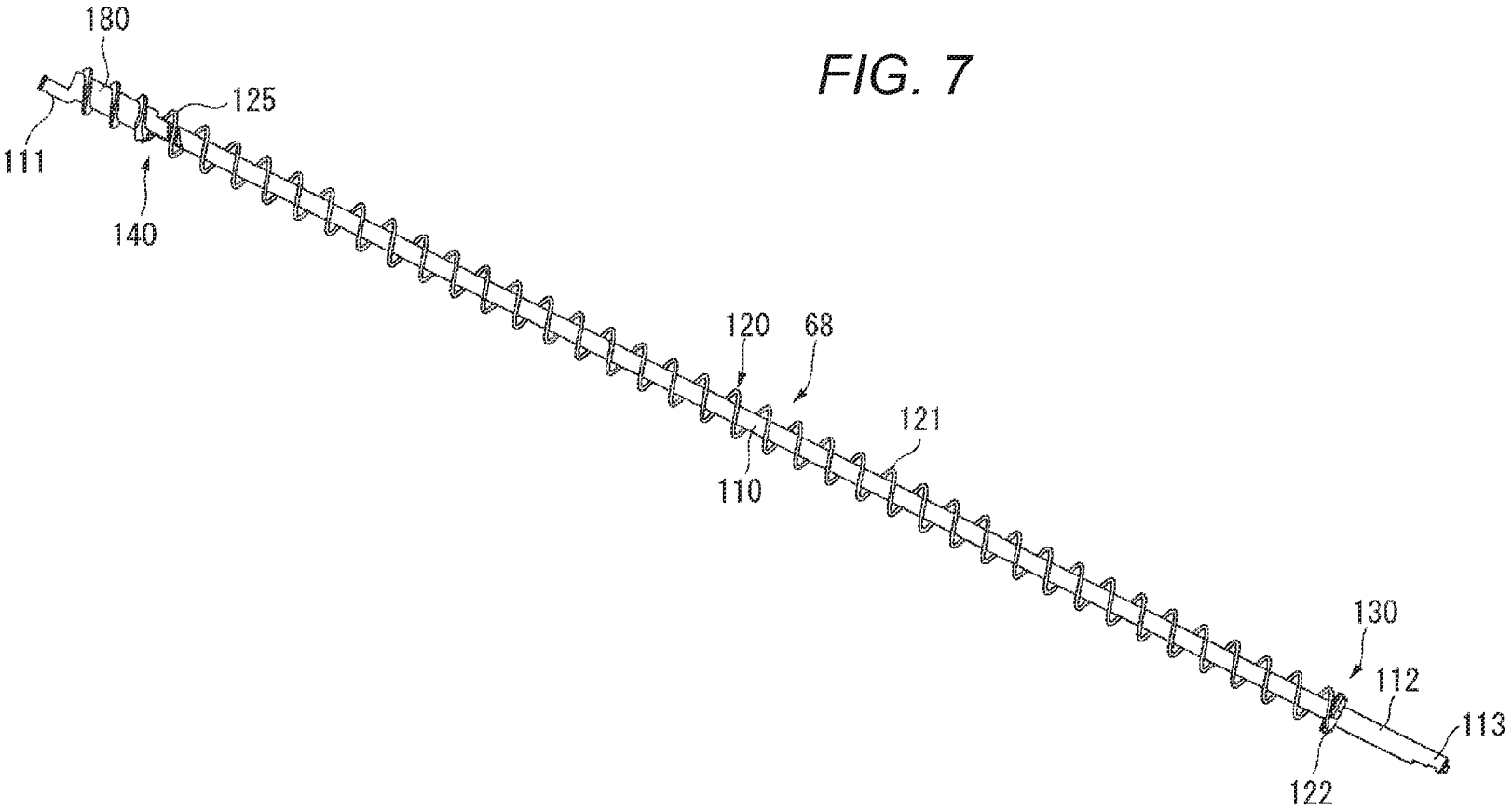
FIG. 7 is a perspective view of a toner transport member used in Exemplary Embodiment 1.
Figure 8:
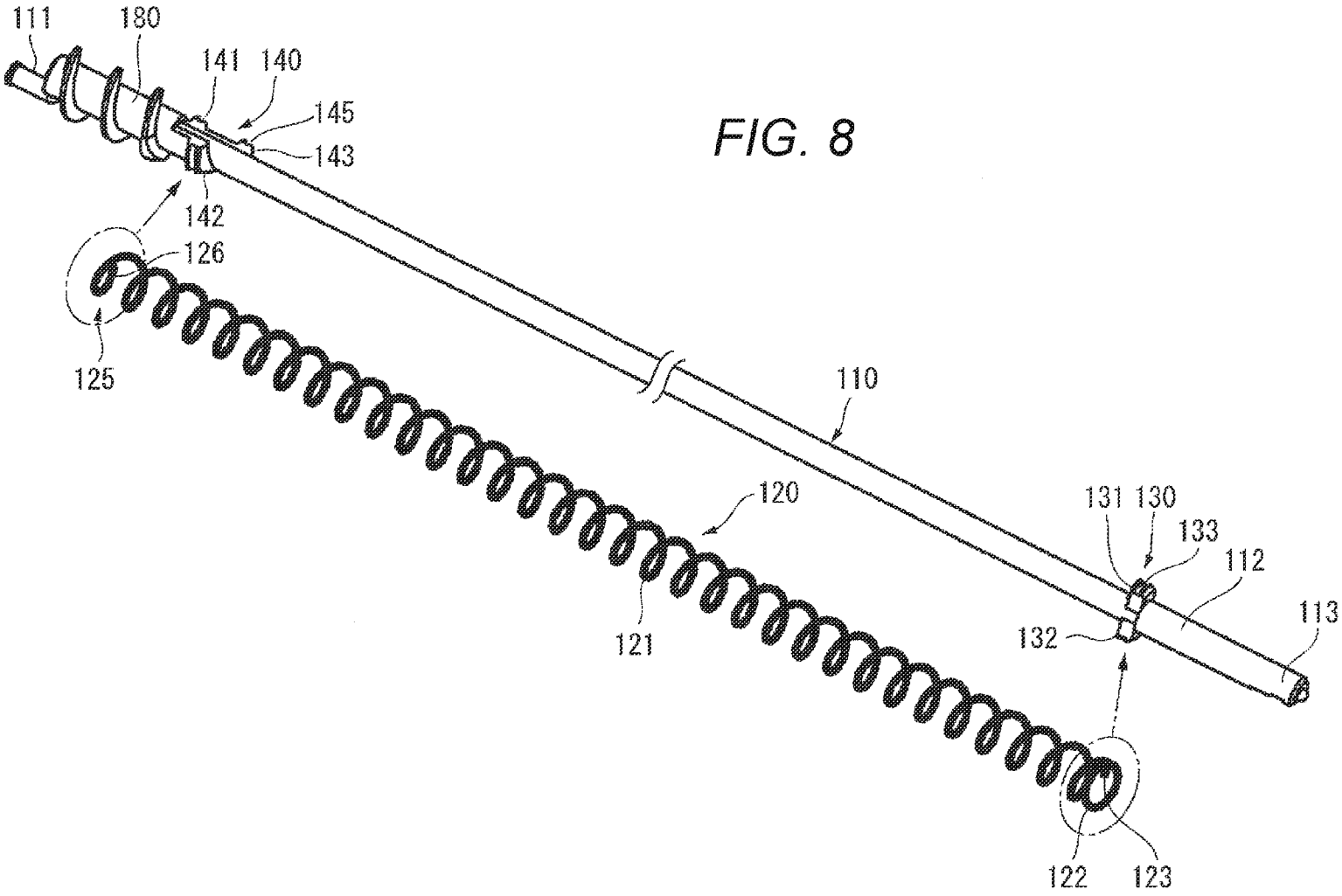
FIG. 8 is an explanatory view illustrating the components, before assembly, of the toner transport member used in Exemplary Embodiment 1.
Figure 9:
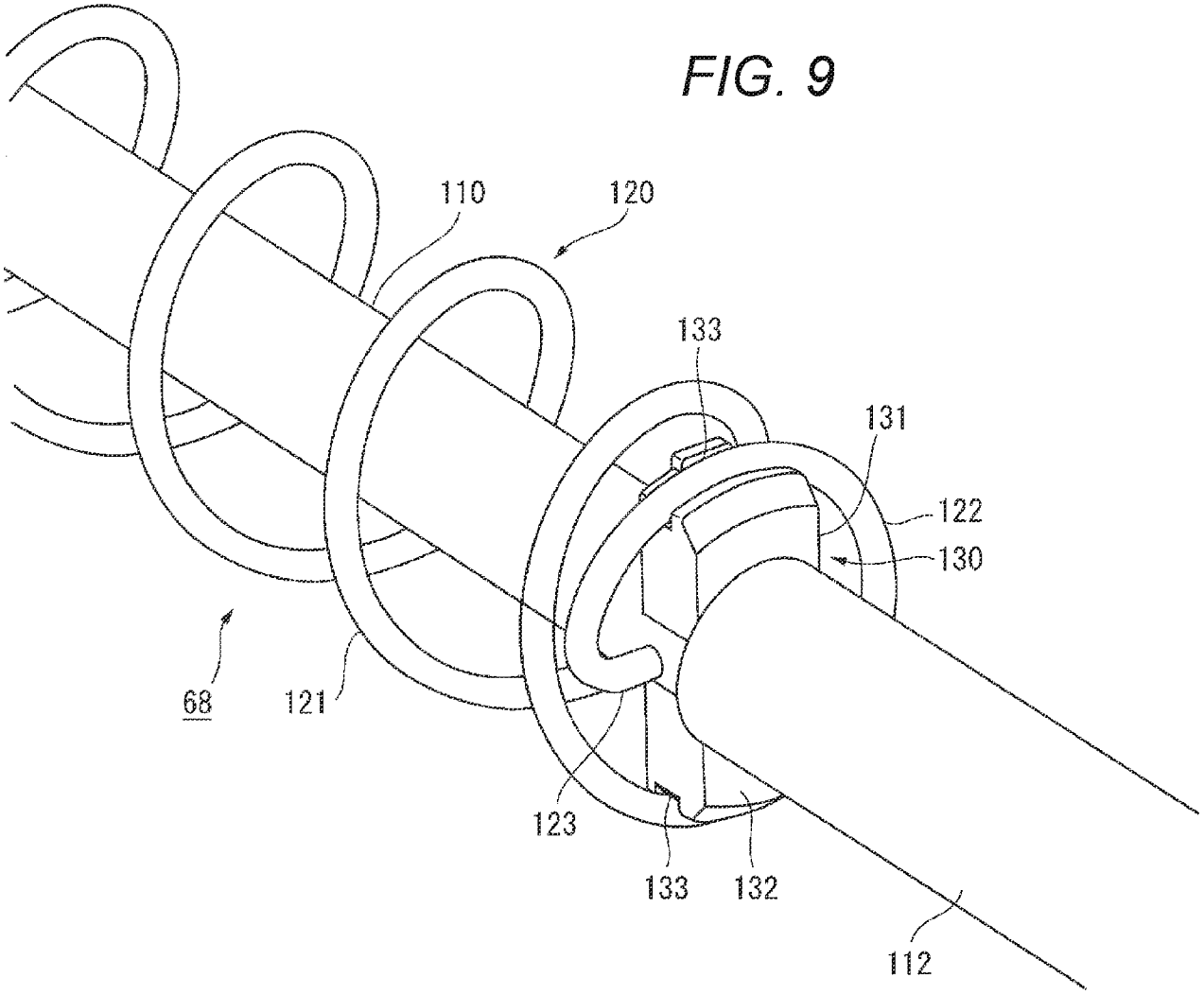
FIG. 9 is a perspective view of a main portion that illustrates a first holding structure of one end portion of a spiral wire with respect to a rotation shaft of the toner transport member used in Exemplary Embodiment 1.

In the present exemplary embodiment, as illustrated in FIGS. 6 to 8, the toner transport member 68 of the cleaner 20 includes: a rotation shaft 110 configured to be rotationally driven and made of resin such as PC/ABS composite resin (polymer alloy), PC, or ABS; a spiral wire made of a metal such as a stainless wire, a piano wire, or a hard steel wire that is wound in a spiral shape at a predetermined pitch in a diameter larger than the outer diameter of the rotation shaft 110 and formed to be capable of being inserted from one end of the rotation shaft 110; and first and second holding parts 130 and 140 integrally provided at the opposite end sides of the rotation shaft 110 and configured to hold the opposite end portions of the spiral wire 120.

In the present exemplary embodiment, as illustrated in FIGS. 3 and 6A, in the toner transport member 68, a support shaft portion 112 having a diameter smaller than that of the other portions is formed at the first holding part 130 side end portion of the rotation shaft 110 in the axial direction, and a bearing member 160 is mounted between the support shaft portion 112 and the cleaning container 66. The tip end of the support shaft portion 112 is formed as a D-cut portion 113, and a drive transmission gear 170 as a drive transmission member is mounted on the D-cut portion 113 such that a drive force supplied from a drive motor (not illustrated) is transmitted to the drive transmission gear 170, for example, via the drum-type photoreceptor body 14.

In addition, in the present exemplary embodiment, as illustrated in FIGS. 3 and 6B, in the toner transport member 68, a resin-made spiral blade 180 is integrally molded at the second holding part 140 side end portion of the rotation shaft 110 in the axial direction, and the spiral blade 180 is formed in a spiral shape at the same pitch as the pitch of the spiral wire 120 to be continued from the spiral wire 120 held by the second holding part 140.

In the present example, the eccentric pin 111 is integrally molded in an end portion of the resin-made spiral blade 180.

<Rotation Shaft>

In the present exemplary embodiment, in the rotation shaft 110 of the toner transport member 68, as illustrated in FIG. 8, the length L of an area between the first and second holding parts 130 and 140 in the axial direction, is set to a length corresponding to a maximum image forming area of the photoreceptor body 14, and the metal-made spiral wire 120 is arranged within the area.

Accordingly, in the present example, the resin-made spiral blade 180 is arranged at a position out of the maximum image forming area of the photoreceptor body 14.

<Spiral Wire>

In the present exemplary embodiment, the spiral wire 120 is configured as a spiral portion 121 that has an inner diameter larger than the outer diameter j of the rotation shaft 110 and is wound in a spiral shape at a predetermined pitch p. The wire diameter of the spiral wire 120 is d.

One end of the spiral wire 120 located at the first holding part 130 side includes a terminal end circular arc portion 122 formed in a circular arc shape having the same outer diameter as the outer diameter of the spiral portion 121. In the present example, in the terminal end circular arc portion 122, at least the circular arc portion needs to exceed a half circumference, and, in consideration of the relation with the first holding part 130, it is desirable that the circular arc portion reaches near one (1) circumference from ¾ circumference.

The tip end of the terminal end circular arc portion 122 includes a bent portion 123 bent toward the center side of the rotation shaft 110, and the bending length of the bent portion 123 is selected such that the bent portion 123 does not contact with the peripheral surface of the rotation shaft 110. At this time, in order not to increase the outer diameter of the spiral wire 120, the bending length of the bent portion 123 may be short. However, since a length of at least about 2 mm is required for bending processing of the bent portion 123 of the tip end of the terminal end circular arc portion 122, a technique for arranging the bent portion 123 not to be in contact with the rotation shaft 110 is employed, in which for example, a concave portion is formed in a part of the rotation shaft 110 and the tip end of the bent portion 123 is accommodated within the concave portion.

In addition, the other end portion of the spiral wire 120 located at the second holding part 140 side is configured as a terminal end spiral portion 125 that has the same pitch p and the same outer diameter as those of an ordinary spiral portion 121 and is opened at the terminal end thereof, and the terminal end spiral portion 125 includes a bent portion 126 bent toward the center side of the rotation shaft 110 at the terminal end thereof.

<First Holding Part>

In the present exemplary embodiment, as illustrated in FIGS. 7 to 11, the first holding part 130, includes protrusions 131 and 132 of a paired configuration at symmetrical positions with the center of the rotation shaft 110 being interposed therebetween, and concave portions 133 in which the inner peripheral surface of the terminal end circular arc portion 122 may be accommodated are formed at the protruding end portion of each of the protrusions 131 and 132.

In the present exemplary embodiment, the concave portion 133 of each of the protrusions 131 and 132 may have a depth size of ½ or more of the wire diameter d of the spiral wire 120 and may be configured to accommodate the inner peripheral surface of the terminal end circular arc portion 122 over a sectional half circumference.

In the present example, the width size of the protrusions 131 and 132 in the direction of the rotation shaft 110 is formed such that the width size at the protruding end side is narrow compared to that at the base side (the center side of the rotation shaft), and the width size w1 of each of the protrusions 131 and 132 at the protruding end portion in the direction of the rotation shaft 110 is selected to be less than ½ of an inter-wire distance k(p−d) obtained by subtracting the wire diameter d from the pitch p of the spiral wire 120. In the present example, while the base side of each of the protrusions 131 and 132 is configured to be thick, the configuration is not limited thereto as long as the other side does not interfere with the protrusion 132 when the spiral wire 120 climbs over the protrusion 131 disposed at one side.

In the present exemplary embodiment, the protruding end portion of each of the protrusions 131 and 132 in the first holding part 130 has a stepped portion 134 in which the height at the entrance side of the terminal end circular arc portion 122 toward the concave portion 133 is lower than that at the opposite side. In addition, in the stepped portion 134, an inclined portion 135 is formed which is inclined such that the protrusion size gradually increases toward the concave portion 133.

<Second Holding Part>

In the present exemplary embodiment, as illustrated in FIGS. 7, 8, and 12 to 14, the second holding part 140 includes three (3) protrusions 141 to 143 at an interval of half circumference of the rotation shaft 110 and at an interval of the pitch p of the spiral wire 120, and concave portions 145 in which the inner peripheral surface of the terminal end spiral portion 125 may be accommodated are formed at protruding end portion of each of the protrusions 141 to 143. In other words, among the three protrusions 141 to 143, the protrusions 141 and 143 are arranged on the same side to be spaced apart from each other by one pitch in the direction of the rotation shaft 110, and the protrusion 142 is arranged at a position that is spaced by a ½ pitch in the direction of the rotation shaft 110 between the protrusions 141 and 143 and displaced by a half circumference from the protrusions 141 and 143.

In the present exemplary embodiment, the second holding part 140 includes a thick portion 146 in which the shaft diameter of the rotation shaft 110 is set to be thicker than that of the other portions to be the same diameter as the shaft portion of the resin-made spiral blade 180, and the protrusions 141 to 143 are formed in the thick portion 146.

In the present exemplary embodiment, the concave portion 145 of each of the protrusions 141 to 143 may have a depth size of ½ or more of the wire diameter d of the spiral wire 120 and may be configured to accommodate a sectional half circumference or more of the inner peripheral surface of the terminal end spiral portion 125.

In the present example, the width size of each of the protrusions 141 to 143 in the direction of the rotation shaft 110 is formed such that the width size at the protruding end side is narrower than that at the base side, and the width size w2 of each of the protrusions 141 and 143 at the protruding end portion in the direction of the rotation shaft 110 is selected to be less than ½ of an inter-wire distance (p−d) obtained by subtracting the wire diameter d from the pitch p of the spiral wire 120. In the present example, while the base side of each of the protrusions 141 to 143 is configured to be thick, the configuration is not limited thereto as long as the other side does not interfere with the protrusion 142 when the terminal end spiral portion 125 climbs over the protrusions 141 and 143 disposed on one side.

In the present exemplary embodiment, the protruding end portion of each of the protrusions 141 to 143 in the second holding part 140 has a stepped portion 147 in which the height at the entrance side of the terminal end spiral portion 125 toward the concave portion 145 is lower than the height at the opposite side. In addition, in the stepped portion 147, an inclined portion 148 is formed which is inclined such that the protrusion size gradually increases toward the concave portion 145.

In a portion of the thick portion 146 of the rotation shaft 110 that corresponds to the bent portion 126 of the terminal end spiral portion 125 of the spiral wire 120, a groove 149 as a hooking portion is formed along the direction of the rotation shaft 110, the bent portion 126 is hooked in the groove 149 such that the terminal end spiral portion 125 is prevented from rotating.

Figure 13A:
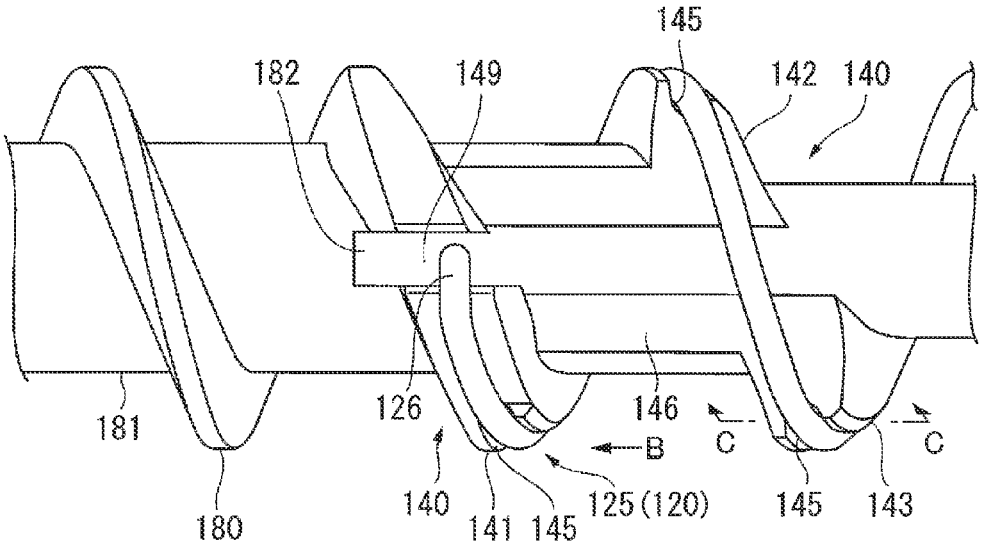
FIG. 13A is an explanatory view illustrating the dimensional relation of the second holding member illustrated in FIG. 12.

In particular, in the present example, as illustrated in FIG. 13A, the groove 149 as a hooking portion includes an extension portion 182 that extends in the direction of the rotation shaft toward a shaft portion 181 of the spiral blade 180, and the length of the groove 149 as a hooking portion in the direction of the rotation shaft is formed to be widened as much as the extension portion 182. Accordingly, even if a variation occurs to that extent in the bending direction of the bent portion 126 of the terminal end spiral portion 125, the bent portion 126 may be easily hooked in the groove 149.

Assembly of Toner Transport Member

In the present exemplary embodiment, as illustrated in FIG. 8, when the toner transport member 68 is assembled, the first holding part 130, the second holding part 140, and the spiral blade 180 may be integrally molded on the rotation shaft 110, and then the spiral wire 120 is inserted from one end portion of the rotation shaft 110 such that the opposite end portions of the spiral wire 120 are held by the first holding part 130 and the second holding part 140, respectively. In addition, after the spiral wire 120 is assembled with the rotation shaft 110, the bearing member 160 and the drive transmission gear 170 may be mounted on the one end portion of the rotation shaft 110.

Figure 14A:
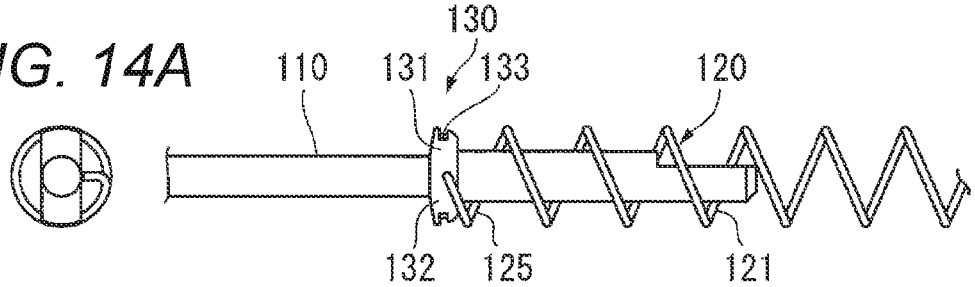
FIGS. 14A, 14B, 14C, 14D, 14E and 14F are explanatory views illustrating a behavior on the periphery of the first holding structure when the spiral wire is inserted into and assembled with the rotation shaft of the toner transport member, in which a left figure in each of FIGS. 14A to 14F illustrates a view obtained when viewing a right figure from the left side.
Figure 14B:
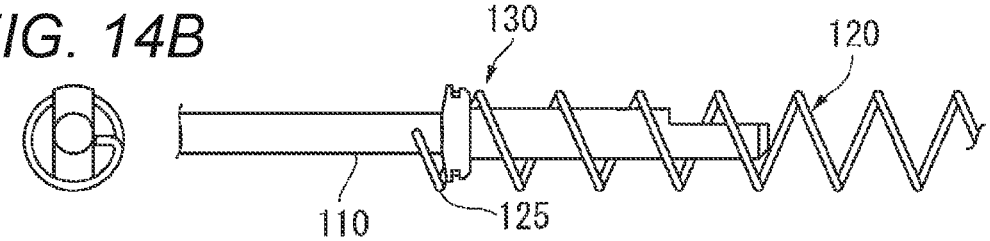
Figure 14C:
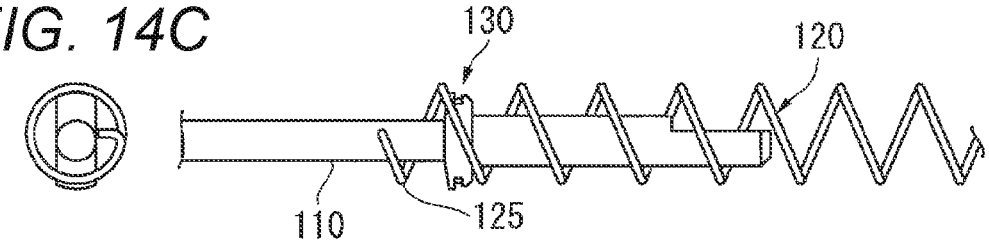

Now, when the spiral wire 120 is inserted from the one end portion of the rotation shaft 110, as illustrated in FIG. 14A, the terminal end spiral portion 125 of the spiral wire 120 contacts with the protrusions 131 and 132 of the first holding part 130. At this time, since the width size w1 of the protruding end portions of the protrusions 131 and 132 is less than ½ of the inter-wire distance (pitch p−wire diameter d) of the spiral wire 120 (similarly, the terminal end spiral portion 125), when the spiral wire 120 is moved up and down with respect to the rotation shaft 110 for every half pitch as illustrated in FIGS. 14B and 14C, the spiral wire 120 is caused to climb over the protrusions 131 and 132 and linearly advance along the axial direction of the rotation shaft 110 while oscillating up and down.

Figure 15A:
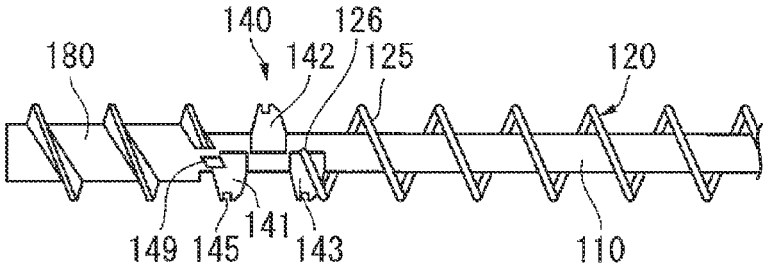
FIGS. 15A, 15B, 15C, 15D, 15E and 15F are explanatory views illustrating a behavior on the periphery of the second holding structure when the spiral wire is inserted into and assembled with the rotation shaft of the toner transport member.
Figure 15B:
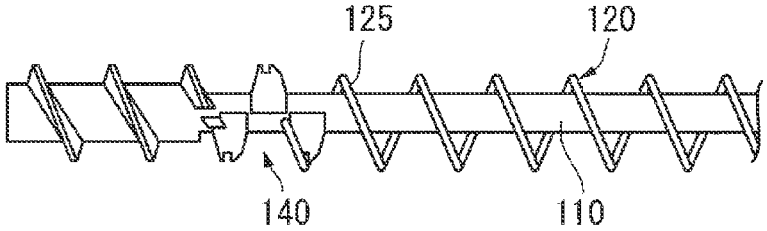
Figure 15C:
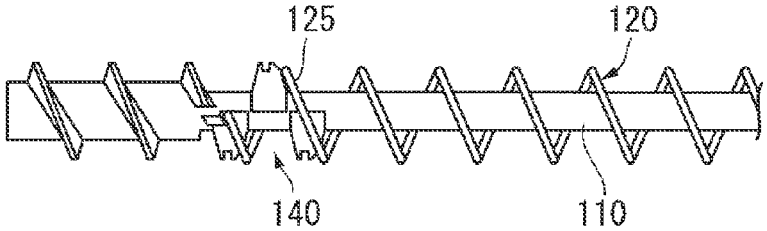
Figure 15D:
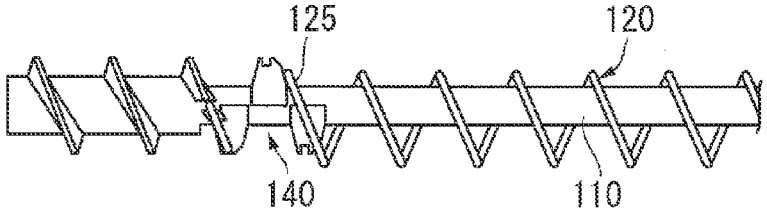
Figure 15E:
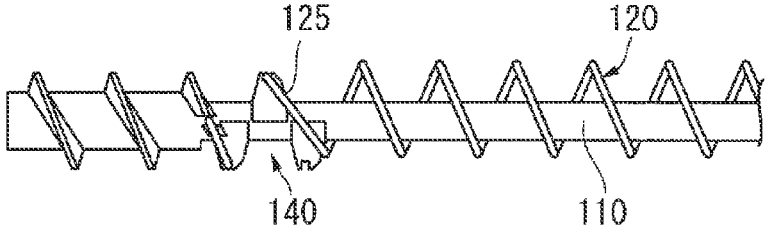
Figure 15F:
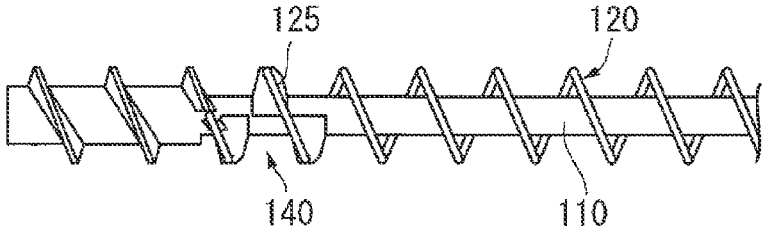

Then, as illustrated in FIG. 15A, when the terminal end spiral portion 125 of the spiral wire 120 approaches the second holding part 140, as illustrated in FIGS. 15A to 15C, the spiral wire 120 may be caused to advance to climb over the protrusions 141 to 143 while moving the terminal end spiral portion 125 up and down by a half pitch, then, as illustrated in FIG. 15D, the bent portion 126 of the terminal end spiral portion 125 may be hooked in the groove 149 as a hooking portion, then, for example, as illustrated in FIG. 15D, the terminal end spiral portion 125 may be stopped in the concave portion 145 of the first protrusion 141 of the second holding part 140, then, as illustrated in FIG. 15E, the terminal end spiral portion 125 may be stopped in the concave portion 145 of the second protrusion 142, and then, as illustrated in FIG. 15F, the terminal end spiral portion 125 may be stopped in the concave portion 145 of the third protrusion 143.

Figure 16A:
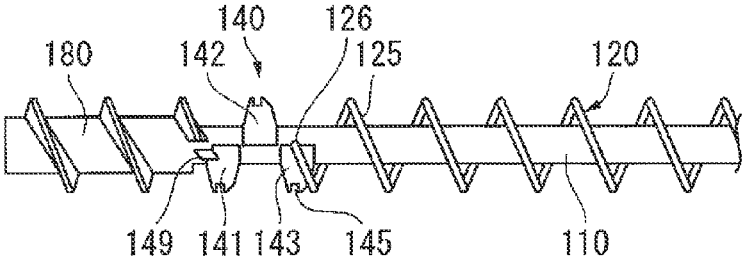
FIGS. 16A, 16B, 16C, 16D, 16E and 16F are explanatory views illustrating a behavior on the periphery of the second holding structure, which is different from that in FIGS. 15A to 15F when the spiral wire is inserted into and assembled with the rotation shaft of the toner transport member.
Figure 16B:
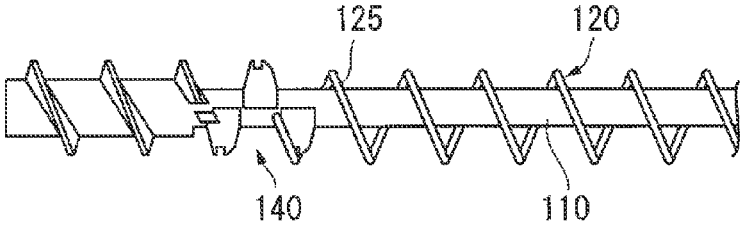
Figure 16C:
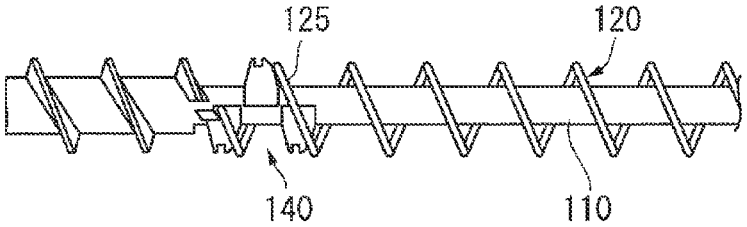
Figure 16D:
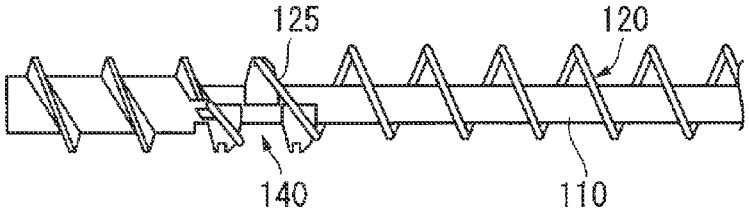
Figure 16E:
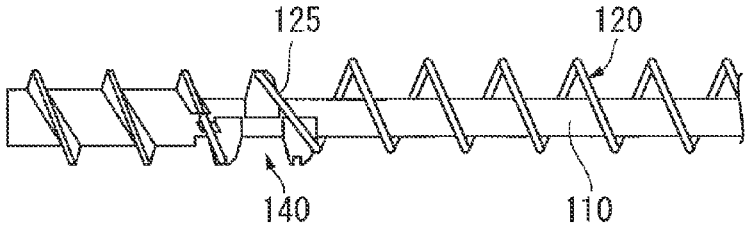
Figure 16F:
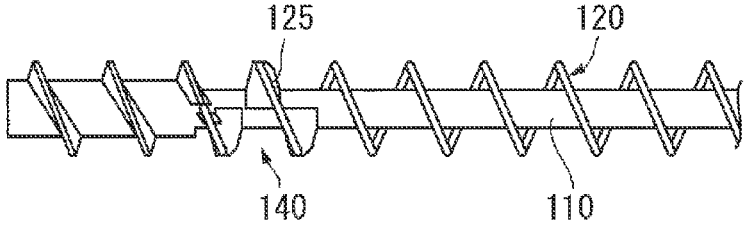

In the present exemplary embodiment, the terminal end spiral portion 125 is configured to be sequentially stopped starting from the first protrusion 141, but is not necessarily limited thereto. Of course, for example, as illustrated in FIGS. 16D to 16F, the terminal end spiral portion 125 may be initially stopped in the concave potion 145 of the second protrusion 142, and subsequently, the terminal end spiral portion 125 may be stopped in the concave portion 145 of each of the first protrusion 141 and the third protrusion 143 located before and after the second protrusion 142.

Figure 14D:
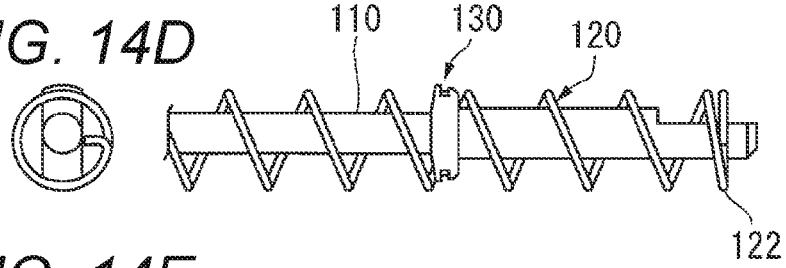
Figure 14E:
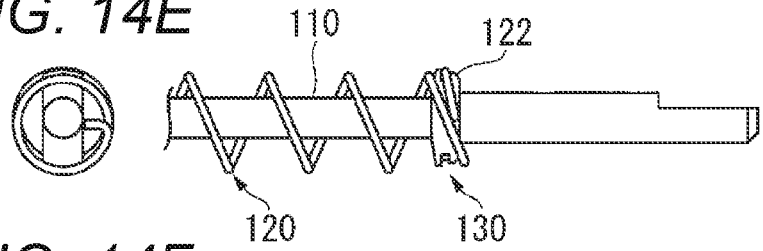
Figure 14F:
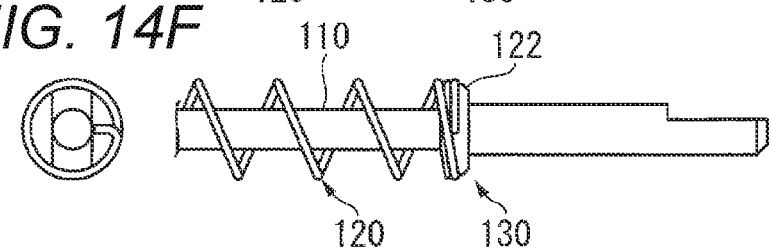

Thereafter, as illustrated in FIGS. 14D and 14E, the spiral wire 120 may be moved up and down for every half pitch along the rotation shaft 110, and, in a state in which the terminal end circular arc portion 122 of the spiral wire 120 arrives at the portions of the protrusions 131 and 132 of the first holding part 130, the terminal end circular arc portion 122 may be stopped in the concave portions 133 of the protrusions 131 and 132, as illustrated in FIG. 14F.

In this state, the terminal end circular arc portion 122 of the spiral wire 120 is stopped in the concave portion 133 of each of the protrusions 131 and 132 that are the first holding part 130 and held at two points, and the bent portion 123 of the terminal end circular arc portion 122 is arranged in a space portion between the protrusions 131 and 132.

<Holding Structure Using First Holding Part>

In the first holding part 130, diagonal portions of the terminal end circular arc portion 122 are stopped in the concave portions 133 of the protrusions 131 and 132 of a paired configuration. At this time, while reaction forces are applied from the concave portions 133 of the protrusions 131 and 132 to the terminal end circular arc portion 122, such reaction forces act in the directions of cancelling each other. Accordingly, such reaction forces do not act on the terminal end circular arc portion 122 as moment, and there is a little concern that the terminal end circular arc portion 122 comes out from the concave portions 133 of the protrusions 131 and 132.

In the present example, since the bent portion 123 of the terminal end circular arc portion 122 is arranged in the space portion between the protrusions 131 and 132, there is a possibility that the bent portion 123 moves within the space portion. However, when the rotation shaft 110 is driven and rotated, the terminal end circular arc portion 122 of the spiral wire 120 is rotated following the rotation. However, even if the bent portion 123 of the terminal end circular arc portion 122 is moved in the space portion between the protrusions 131 and 132, such a movement is stopped as the bent portion 123 is disposed in contact with or in proximity to one of the protrusions 131 and 132. For this reason, the bent portion 123 of the terminal end circular arc portion 122 is hooked in the protrusion 131 or the protrusion 132, and the rotation of the terminal end circular arc portion 122 is prevented. Accordingly, the terminal end circular arc portion 122 of the spiral wire 120 is held at two points in a rotation-prevented state (so that the terminal end circular arc portion 122 is prevented to be rotated).

<Holding Structure Using Second Holding Part>

In the second holding part 140, the terminal end spiral portion 125 of the spiral wire 120 is stopped in the concave portion 145 of each of the protrusions 141 to 143 that are the second holding part 140 and held at three points, and the bent portion 126 of the terminal end spiral portion 125 is hooked in the groove 149 as a hooking portion in the rotation-prevented state.

For this reason, the terminal end spiral portion 125 of the spiral wire 120 is held at three points in the rotation-prevented state.

Figure 17A:
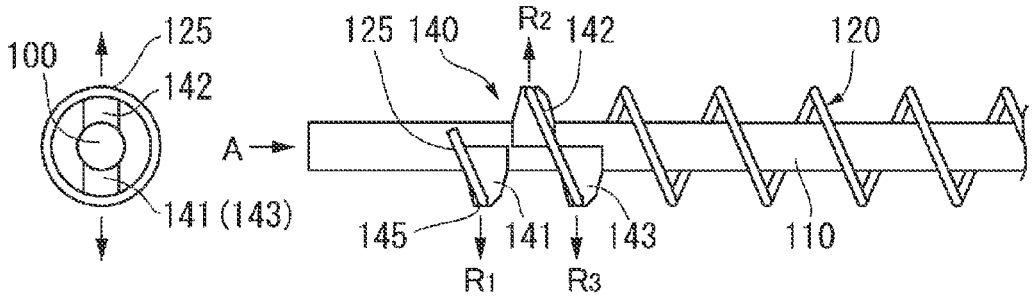
FIG. 17A is an explanatory view illustrating forces applied to the spiral wire in the second holding structure of the toner transport member used in Exemplary Embodiment 1, in which the left figure is a view obtained when viewing the right in direction A.

At this time, in the present example, as illustrated in FIG. 17A, since the protrusions 141 to 143 that are the second holding part 140 are provided for every half circumference of the rotation shaft 110, the reaction forces R1 to R3 from the concave portions 145 of the protrusions 141 to 143 are applied such that the first and third reaction forces act in a same direction, and the second reaction force act toward a direction opposite to the directions of the first and third reaction forces. Thus, no moment acts on the terminal end spiral portion 125 by a resultant force of the reaction forces R1 to R3, and it is expected that the terminal end spiral portion 125 does not come out from the second holding part 140.

Figure 17B:
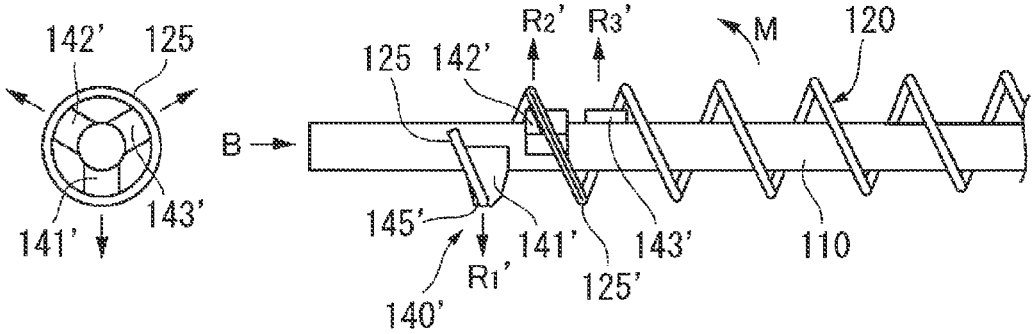
FIG. 17B is an explanatory view illustrating forces applied to the spiral wire in the second holding structure of the toner transport member used in Comparative Form 1, in which the left figure is a view obtained when viewing the right figure in direction B.

In contrast, for example, as in Comparative Form 1 illustrated in FIG. 17B, in an aspect in which protrusions 141' to 143' are provided at an interval of ⅓ circumference (an angular interval of 120 degrees) in the second holding part 140', and a concave portion 145' is formed at the protruding end portion of each of the protrusions 141' to 143', reaction forces R1' to R3' from the concave portions 145' of the protrusions 141' to 143' are applied such that the first reaction force acts, for example, in the downward direction in the drawing, and the second and third reaction forces act in the upward direction to be opposite to the first reaction force. For this reason, moment T (see FIG. 17B) is applied to the terminal end spiral portion 125 by a resultant force of the reaction forces R1' to R3'. Accordingly, the terminal end spiral portion 125 may easily come off, and the holding state using the second holding part 140' is unstable.

Figure 18A:
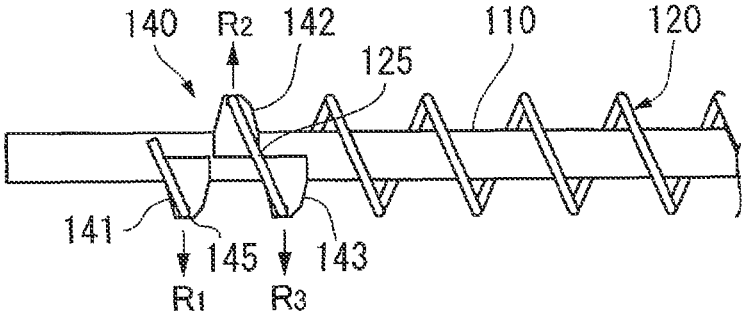
FIG. 18A is an explanatory view illustrating forces applied to the spiral wire in the second holding structure of the toner transport member used in Exemplary Embodiment 1.
Figure 18B:
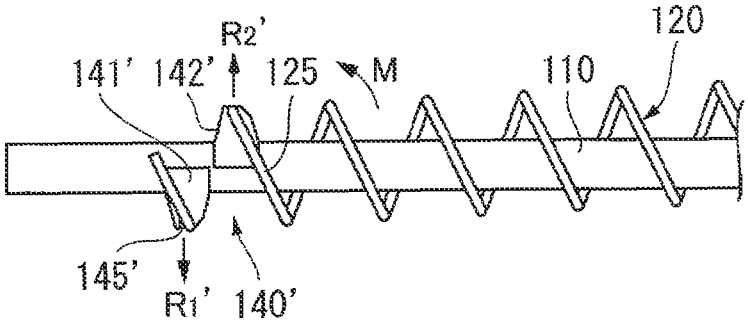
FIG. 18B is an explanatory view illustrating forces applied to a spiral wire in a second holding structure of a toner transport member used in Comparative Form 2.

In addition, in contrast with Exemplary Embodiment 1 illustrated in FIG. 18A, as in Comparative Form 2 illustrated in FIG. 18B, in an aspect in which two protrusions 141' and 142' are provided at an interval of half circumference in the second holding part 140', and a concave portion 145' is formed at the protruding end portion of each of the protrusions 141' and 142', reaction forces R1' and R2' from the concave portions 145' of the protrusions 141' and 142' are applied such that the first reaction force acts in the downward direction, and the second reaction force act in the upward direction to be opposite to the first reaction force. For this reason, moment M (see FIG. 18B acts on the terminal end spiral portion 125 by a resultant force of the reaction forces R1' and R2'. Accordingly, the terminal end spiral portion 125 may easily come off, and the holding state using the second holding part 140' is unstable.

Figure 18C:
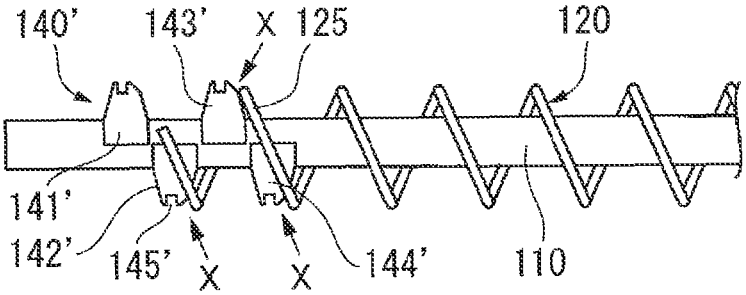
FIGS. 18C and 18D are explanatory views illustrating a method of holding and operating a spiral wire in a second holding structure of a toner transport member used in Comparative Form 3.

In addition, as in Comparative Form 3 illustrated in FIG. 18C, in an aspect in which four protrusions 141' to 144' are provided at an interval of half circumference in the second holding part 140', and a concave portion 145' is formed in the protruding end portion of each of the protrusions 141' to 144', when the terminal end spiral portion 125 is caused to advance to climb over the second to fourth protrusions 142' to 144' while moving the terminal end spiral portion 125 up and down at every half pitch in order to stop the terminal end spiral portion 125 at the concave portion 145' of each of the protrusions 141' to 144', the terminal end spiral portion 125 is hooked in the three protrusions 142' to 144' (indicated by X in the drawing). Accordingly, even by causing the terminal end spiral portion 125 to advance while moving the terminal end spiral portion 125 up and down, it is impossible to linearly insert the terminal end spiral portion 125, and it is difficult to hold the terminal end spiral portion 125 in the concave portions 145' of four protrusions 141' to 144' as the second holding part 140'.

Figure 18D:
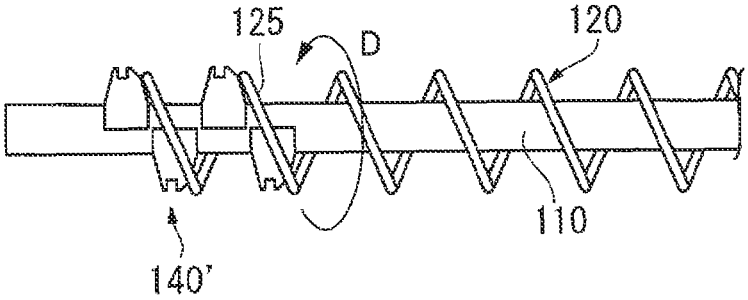

In Comparative Form 3, at the portions at which the terminal end spiral portion 125 is hooked in three protrusions 142' to 144' as illustrated in FIG. 18C, when the terminal end spiral portion 125 as illustrated using an arrow D or is forcibly caused to be deformed to climb over the protrusions as illustrated in FIG. 18D, the terminal end spiral portion 125 may be arranged in front of the concave portions 145' of the four protrusions 141' to 144'. Then, the terminal end spiral portion 125 may be stopped in the concave portion 145' of each of the protrusions 141' to 144', but the holding operation using the second holding part 140' is troublesome.

Assembled State of Toner Transport Member

In the toner transport member 68 according to the present exemplary embodiment, the terminal end spiral portion 125 of the spiral wire 120 is held by the second holding part 140 at three points in the rotation-prevented state, and the terminal end circular arc portion 122 is held by the first holding part 130 at two points in the rotation-prevented state.

In this state, in the second holding part 140, since the terminal end spiral portion 125 is held to be maintained at the pitch of the spiral wire 120, the pitch of the spiral wire 120 held in the rotation shaft 110 is maintained at the predetermined pitch. For this reason, the outer diameter of the spiral wire 120 is maintained without being changed, and when the toner transport member 68 is rotationally driven, the spiral wire 120 hardly presses the toner against the transport wall of the cleaning container 66. Thus, the pressed toner is hardly softened by heat remaining on the conveyance wall, and the degradation of the transportability of toner may be effectively prevented.

In addition, in the present exemplary embodiment, the toner transport member 68 is in an aspect in which the spiral wire 120 is arranged at a portion corresponding to the maximum image forming area of the photoreceptor body 14, and the toner transport member 68 includes a resin-made spiral blade 180 disposed in an area other than the maximum image forming area of the photoreceptor body 14.

For example, in the image forming section 13, at the time of double-sided printing, a sheet receives fixing heat from the fixing unit 18 at the first-side printing. Thus, when the sheet comes in contact with the photoreceptor body 14 at the second-side printing, heat is applied to the photoreceptor body 14, and this heat is transferred to the cleaning 20, the transport wall of the cleaning container 66, and the toner transport member 68. For this reason, in the present exemplary embodiment, in the toner transport member 68, the spiral wire 120 is arranged at a portion corresponding to the sheet contacting portion (maximum image forming area) of the photoreceptor body 14 and the resin-made spiral blade 180 having a high transport property is arranged in a portion other than the sheet contacting portion such that the toner is not pressed against the transport wall of the cleaning container 66, and defective transport according to the softening of the pressed toner caused by the heat of the transport wall is suppressed.

In addition, in the present exemplary embodiment, in the toner transport member 68, the terminal end spiral portion 125 of the spiral wire 120 is arranged to have a spiral trace to be continuous from the resin-made spiral blade 180. Thus, the toner transported by the spiral wire 120 is delivered to the spiral blade 180 without being obstructed.

Modified Form 1

Figure 10A:
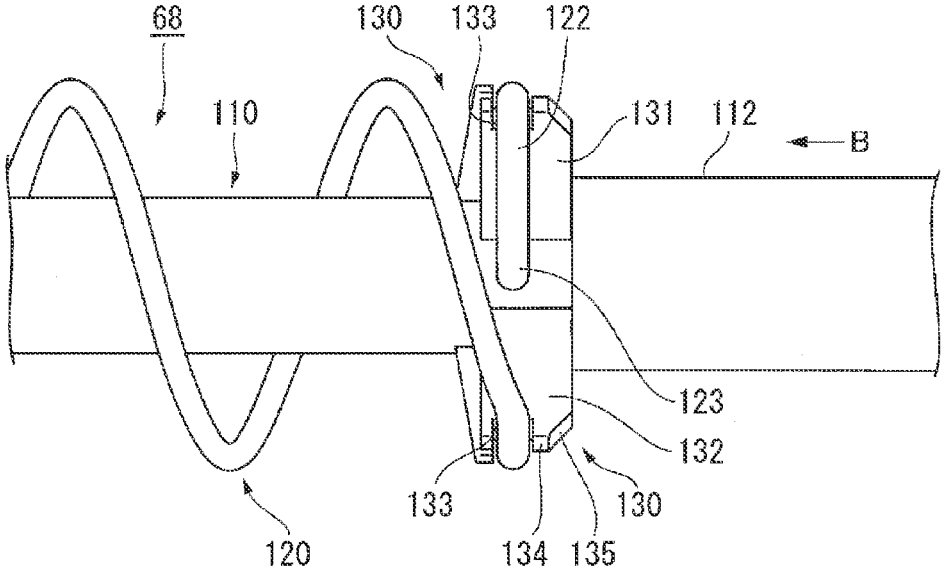
FIG. 10A is an explanatory view illustrating the front side of the holding structure of FIG. 9.
Figure 10B:
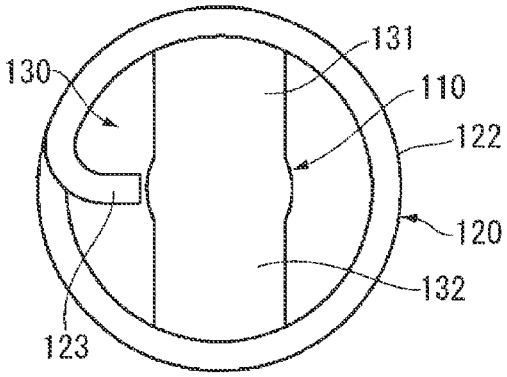
FIG. 10B is a view illustrates a rotation prevention structure at an end portion of the spiral wire when viewed in direction B in FIG. 10A.
Figure 10C:
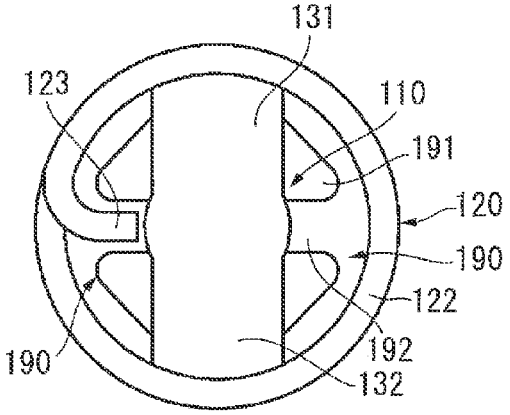
FIG. 10C is an explanatory view illustrating a modified form of the rotation prevention structure illustrated in FIG. 10B.
Figure 11A:
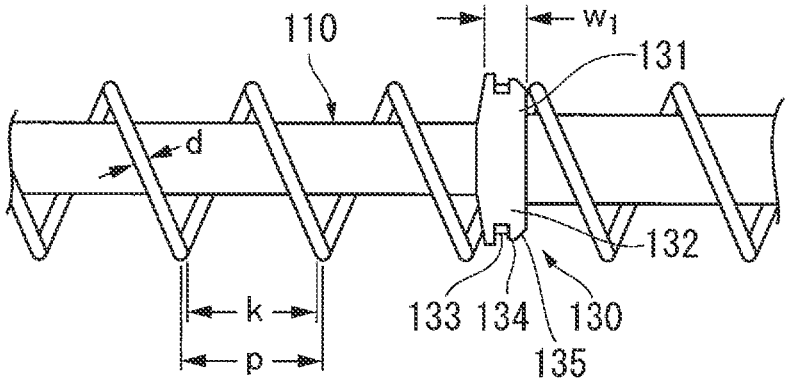
FIG. 11A is an explanatory view illustrating the dimensional relation of the first holding structure illustrated in FIG. 9.
Figure 11B:
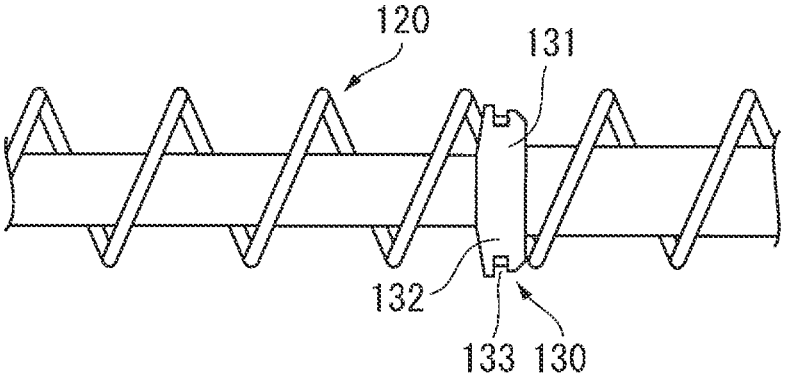
FIG. 11B is an explanatory view illustrating a state in which the spiral wire advances with respect to the rotation shaft by a half pitch from a position illustrated in FIG. 11A.

In the present exemplary embodiment, in the rotation-prevention structure using the first holding part 130, the bent portion 123 of the terminal end circular arc portion 122 of the spiral wire 120 is arranged in a space portion between the protrusions 131 and 132 that are the first holding part 130. Thus, when the rotation shaft 110 is rotationally driven, the terminal end circular arc portion 122 performs idling to some degree until the bent portion 123 is in contact with or in proximity to one of the protrusions 131 and 132. Without being limited thereto, however, hooking portions 190, in which the bent portion 123 of the terminal end circular arc portion 122 is hooked may be separately provided on the lateral side of the protrusions 131 and 132, as illustrated in FIG. 10C. In such a case, as the hooking portions 190, protruding portions 191 may be formed at the lateral side of the protrusions 131 and 132, a groove 192 are formed at the portions of the protruding portions 191 in which the bent portion 123 is hooked, and the bent portion 123 is accommodated in the groove 192 so that the rotation prevention of the terminal end circular arc portion 122 is realized.

Modified Form 2

Figure 12:
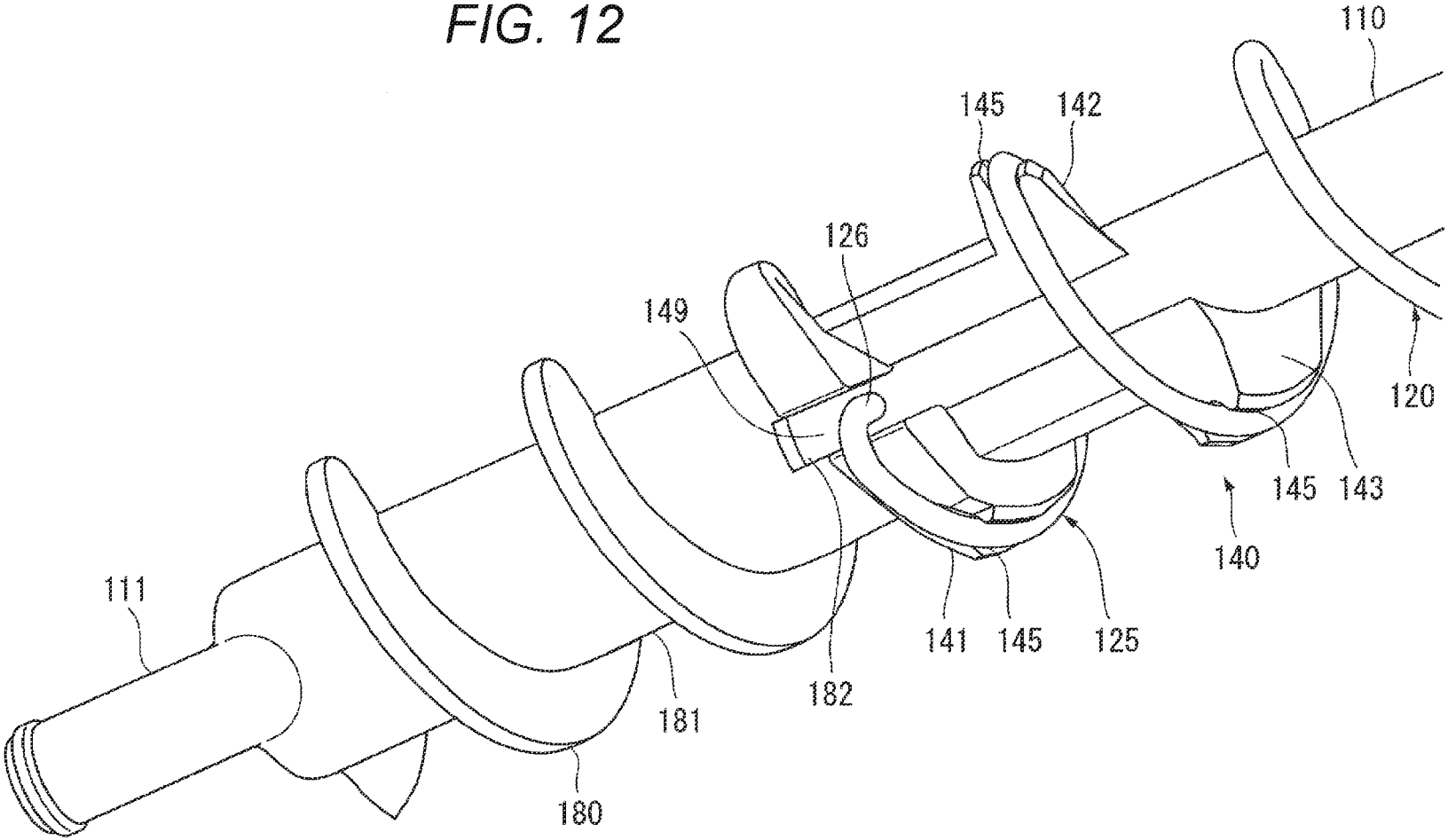
FIG. 12 is a perspective view of a main portion that illustrates a second holding structure of the other end portion of the spiral wire with respect to the rotation shaft of the toner transport member used in Exemplary Embodiment 1.
Figure 13B:
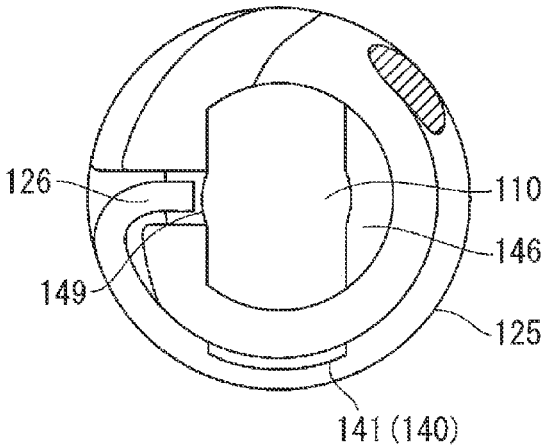
FIG. 13B is a view obtained when viewing the second holding member in direction B in FIG. 13A.
Figure 13C:
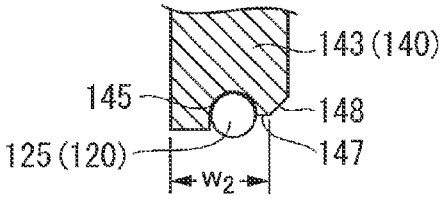
FIG. 13C is a sectional view taken along line C-C in FIG. 13A.
Figure 19:
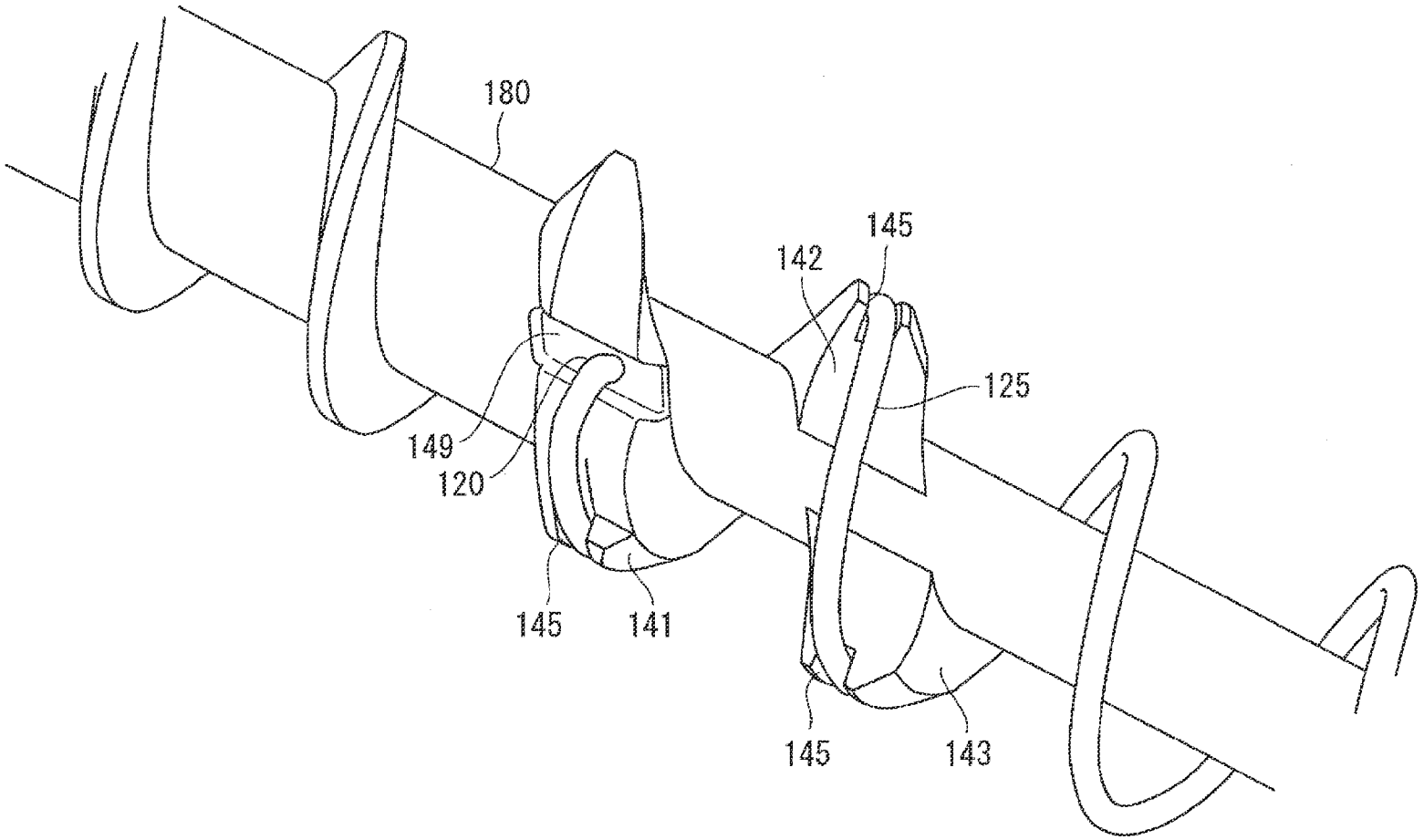
FIG. 19 is an exemplary view illustrating a modified form of the second holding structure illustrated in FIG. 12.

In the present exemplary embodiment, as illustrated in FIGS. 12 and 13, in the second holding part 140, a thick portion 146 is formed in a part of the rotation shaft 110, three (3) protrusions 141 to 143 are formed in the thick portion 146, and a concave portion 145 is formed at the protruding end portion of each of the protrusions 141 to 143. Without being limited thereto, however, for example, as illustrated in FIG. 19, protrusions 141 to 143 each formed with a concave portion 145 may be provided on the rotation shaft 110 without forming the thick portion 146. At this time, the aspect in which the thick portion 146 is not provided, enables to secure a large toner moving space, compared to an aspect in which the thick portion 146 is provided, and thus, the aspect is desirable in that the exchange of toner from the spiral wire 120 to the resin-made spiral blade 180 made may be smoothly performed.

Exemplary Embodiment 2

Figure 20:
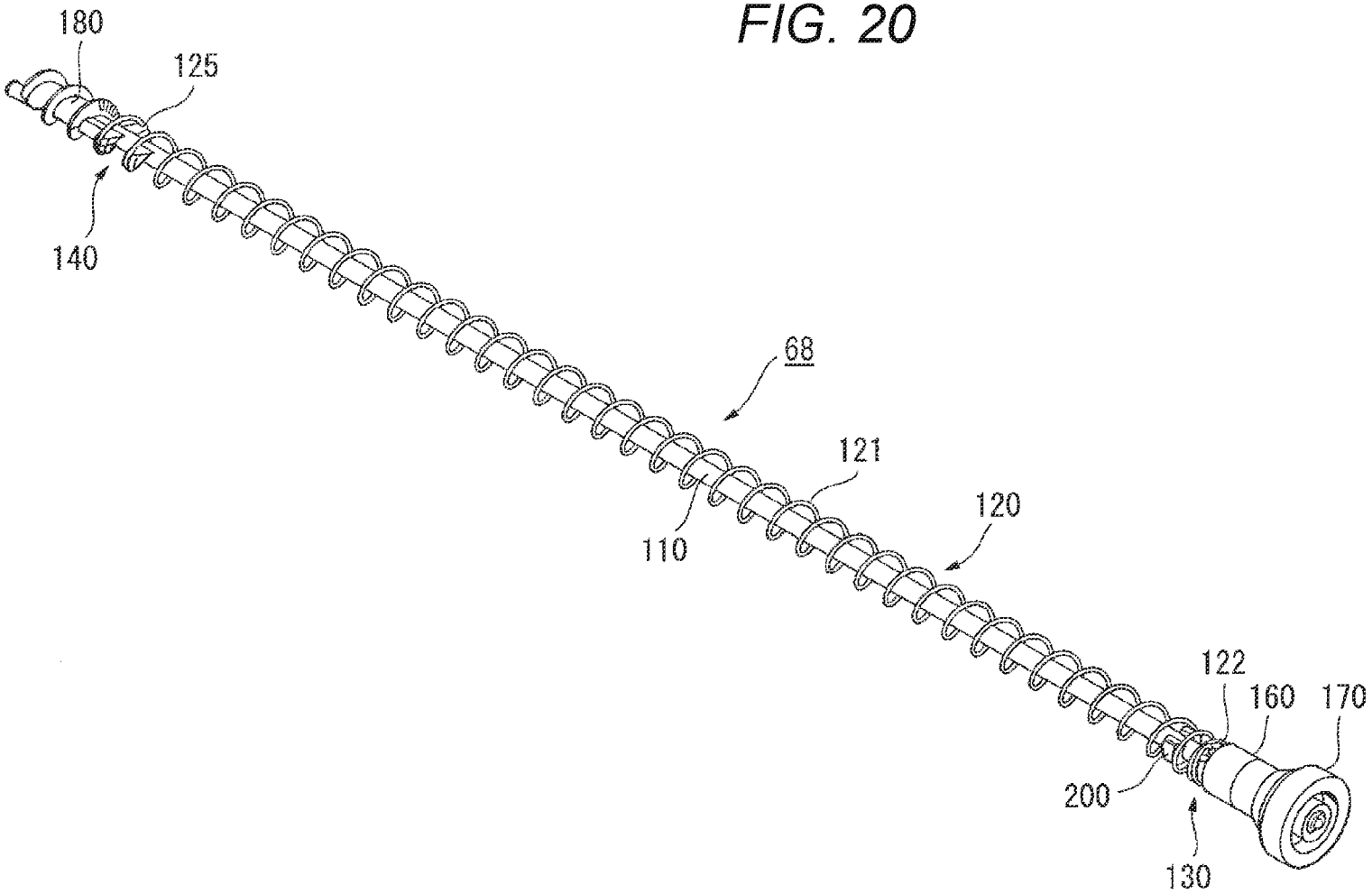
FIG. 20 is an explanatory view illustrating the whole configuration of a toner transport member used in Exemplary Embodiment 2.

FIG. 20 illustrates a toner transport member used in Exemplary Embodiment 2.

In the drawing, similar to Exemplary Embodiment 1, the toner transport member 68 is incorporated into a cleaner 20, and includes a resin-made rotation shaft 110, a metal-made spiral wire 120, and first and second holding parts 130 and 140 that hold the opposite end portions of the spiral wire 120 with respect to the rotation shaft 110. However, unlike Exemplary Embodiment 1, a functional unit that may be used during an operation of mounting the drive transmission gear 170 in the toner transport member 68 is added in the vicinity of the first holding part 130. A constituent element that is the same as that of Exemplary Embodiment 1 will be denoted by the same reference numeral, and a detailed description thereof will be omitted here.

In the present exemplary embodiment, the basic configuration of the first holding part 130 is approximately the same as that of Exemplary Embodiment 1, but is different from Exemplary Embodiment 1, in that an aspect is employed in which a hooking portion 190 (see FIG. 10C) in which a bent portion 123 of a terminal end circular arc portion 122 of a spiral wire 120 is hooked is employed.

In the present example, a gripping protrusion 200 having a diameter smaller than a dimension between the protruding end portions of protrusions 131 and 132 that are a first holding part 130 is provided on the rotation shaft 110 near the first holding part 130.

Figure 21:
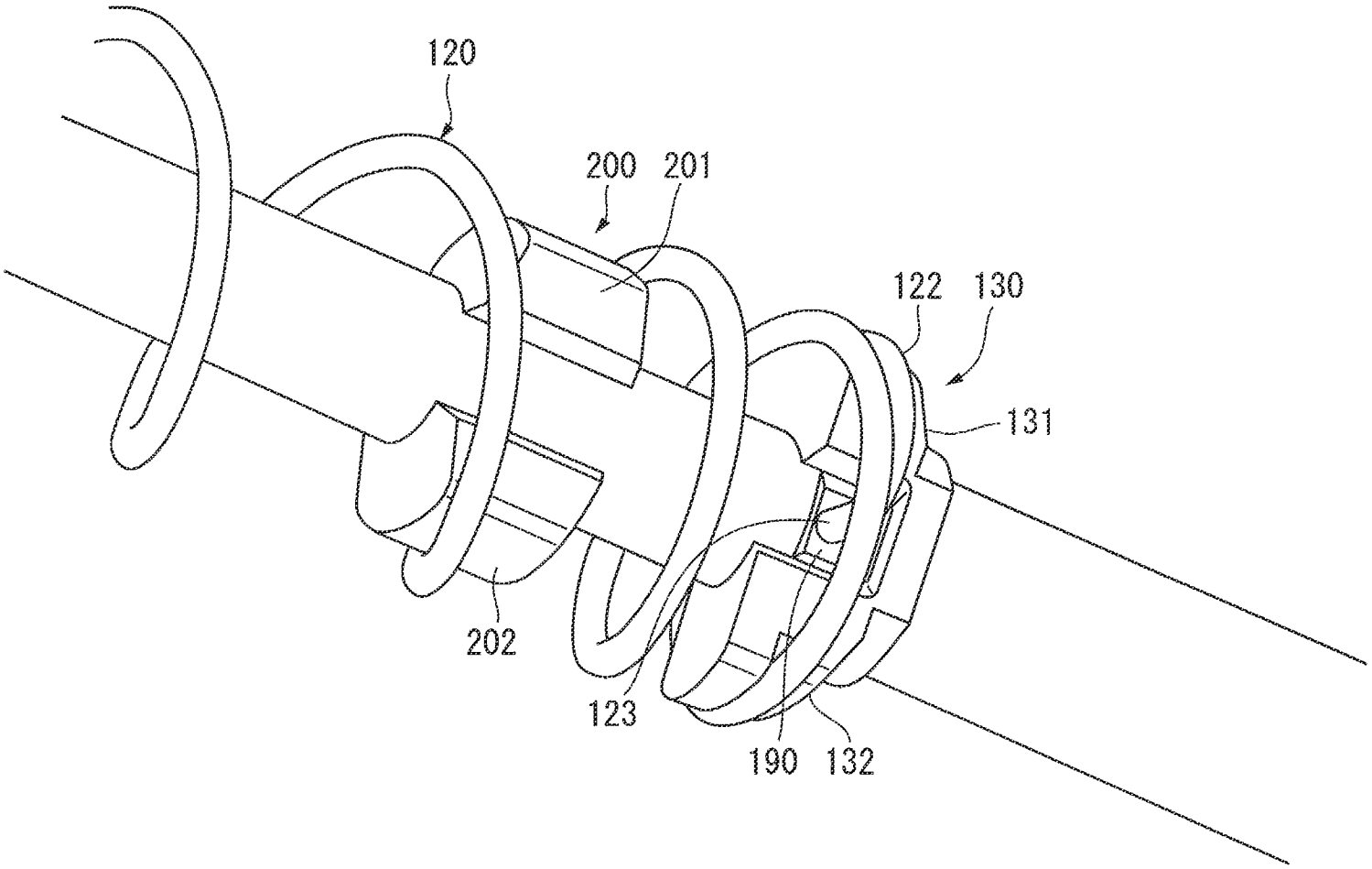
FIG. 21 is an explanatory views illustrating a first holding structure of the toner transport member used in Exemplary Embodiment 2.

As illustrated in FIG. 21, the gripping protrusion 200 has a shape in which protrusions 201 and 202 of a paired configuration protrude at symmetrical positions with the center of the rotation shaft 110 being interposed therebetween. A dimension between the protruding end portions of the protrusions 201 and 202 is selected to be smaller than the inner diameter of the spiral wire 120. In addition, the gripping protrusion 200 is arranged not to be in contact with the spiral wire 120 held on the rotation shaft 110.

Figure 22A:
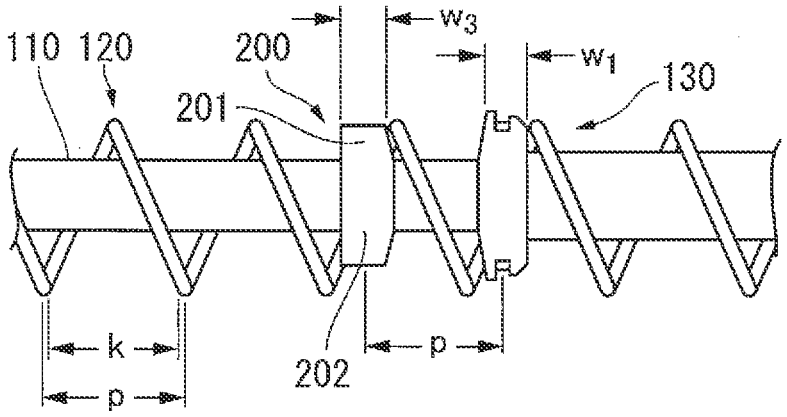
FIG. 22A is an explanatory view illustrating the dimensional relation of the first holding structure illustrated in FIG. 21.
Figure 22B:
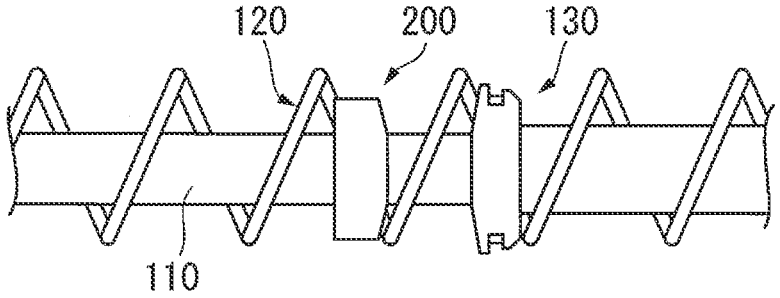
FIG. 22B is an explanatory view illustrating a state in which the spiral wire advances with respect to the rotation shaft by a half pitch from a position illustrated in FIG. 22A.

As illustrated in FIG. 22A, in the present example, the gripping protrusion 200 is installed at a position that is spaced apart from the protrusions 131 and 132 that are the first holding part 130 toward the inner side in the axial direction by one pitch p of the spiral wire 120. The sectional shape of each of the protrusions 201 and 202 may have approximately the same width size in the direction of the rotation shaft. In the present example, however, the width size w3 of the protruding end portion of each of the protrusions 201 and 202 in the direction of the rotation shaft is selected to be narrower than that of the base portion. The width size w3 of the protruding end portion of each of the protrusions 201 and 202 in the direction of the rotation shaft is selected to be less than ½ of an inter-wire distance (p−d) obtained by subtracting a wire diameter d from the pitch p of the spiral wire 120.

In particular, in the present exemplary embodiment, the positional relationship between the gripping protrusion 200 and the first holding part 130 is selected to be one pitch p of the spiral wire 120. Accordingly, as will be described later, when a drive transmission gear 170 as a mounting target is mounted on one end of the rotation shaft 110 of the toner transport member 68, it is possible to grip a portion nearer to the drive transmission gear 170, and thus, the mounting operation may be easily performed. However, the positional relationship between the gripping protrusion 200 and the first holding part 130 is not limited thereto, but may be an integral multiple of the pitch p of the spiral wire 120.

Next, the assembly of the toner transport member according to the present exemplary embodiment will be described.

Figure 23A:
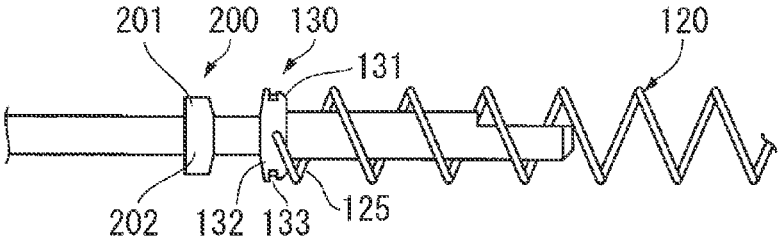
FIGS. 23A, 23B, 23C, 23D, 23E and 23F are explanatory views illustrating a behavior on the periphery of the first holding structure when the spiral wire is inserted into and assembled with the rotation shaft of the toner transport member.
Figure 23B:
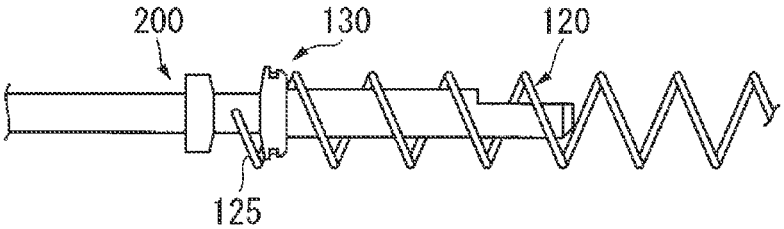

Now, when the spiral wire 120 is inserted from one end portion of the rotation shaft 110, the terminal end spiral portion 125 of the spiral wire 120 contacts with the protrusions 131 and 132 of the first holding part 130, as illustrated in FIG. 23A. At this time, since the width size w1 of the protruding end portions of the protrusions 131 and 132 is less than ½ of the inter-wire distance (pitch p−wire diameter d) of the spiral wire 120 (similarly, the terminal end spiral portion 125), when the spiral wire 120 is moved up and down with respect to the rotation shaft 110 for every half pitch as illustrated in FIGS. 23B and 23C, the spiral wire 120 climbs over the protrusions 131 and 132, and the spiral wire 120 is caused to linearly advance along the axial direction of the rotation shaft 110 while oscillating vertically.

Figure 23C:
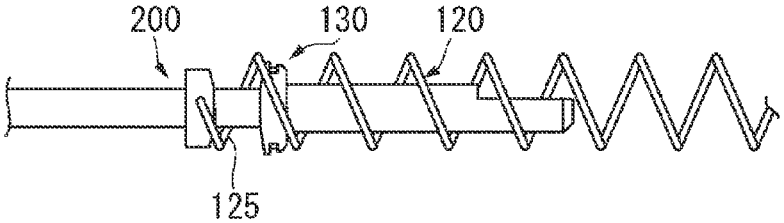

In the present example, as illustrated in FIG. 23C, when the tip end of the terminal end spiral portion 125 of the spiral wire 120 passes through the first holding part 130 and advances by one pitch p, the spiral wire 120 contacts with the gripping protrusion 200. In this state, since the spiral wire 120 climbs over the first holding part 130 and thus advances along the rotation shaft 110 while upwardly/downwardly moving for every half pitch. However, since the width size w3 of the protruding end portion of each of the protrusions 201 and 202 of the gripping protrusion 200 is less than ½ of the inter-wire distance (pitch p−wire diameter d), the spiral wire 120 climbs over the gripping protrusion 200 as the spiral wire 120 (and also the terminal end spiral portion 125) advances along the rotation shaft 110 with the up and down movements for every half pitch.

Figure 23D:
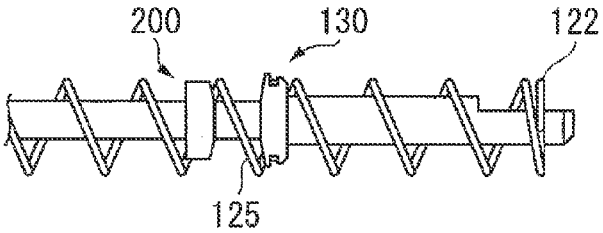
Figure 23E:
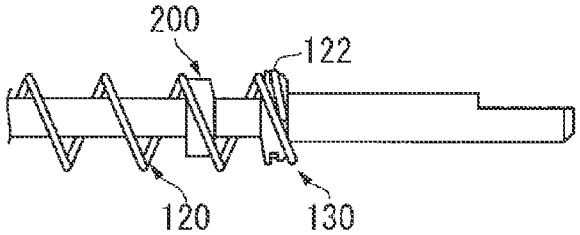
Figure 23F:
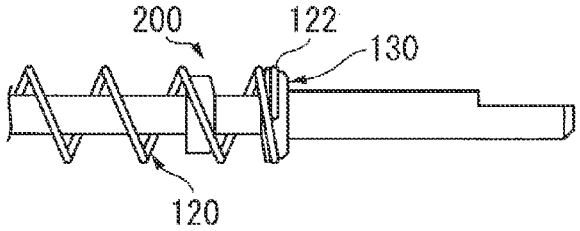

Thereafter, as illustrated in FIGS. 23D and 23E, the spiral wire 120 is moved up and down along the rotation shaft 110 for every half pitch, and, in a state in which the terminal end circular arc portion 122 of the spiral wire 120 arrives at the portions of the protrusions 131 and 132 of the first holding part 130 the terminal end circular arc portion 122 may be stopped in the concave portions 133 of the protrusions 131 and 132, as illustrated in FIG. 23F. Similar to Exemplary Embodiment 1, the terminal end spiral portion 125 of the spiral wire 120 is supported by the second holding part 140 at three points in the rotation-prevented state.

In this state, the terminal end circular arc portion 122 of the spiral wire 120 is stopped in the concave portions 133 of the protrusions 131 and 132 that are the first holding part 130 and are held at two points, and the bent portion 123 of the terminal end circular arc portion 122 is hooked in the hooking portion 190.

In this way, when the spiral wire 120 is held by the rotation shaft 110, the gripping protrusion 200 is held in a state in which the gripping protrusion 200 does not contact with the spiral wire 120.

Next, descriptions will be made on a case in which the bearing member 160 and the drive transmission gear 170 are mounted on the toner transport member according to the present exemplary embodiment.

Figure 24A:
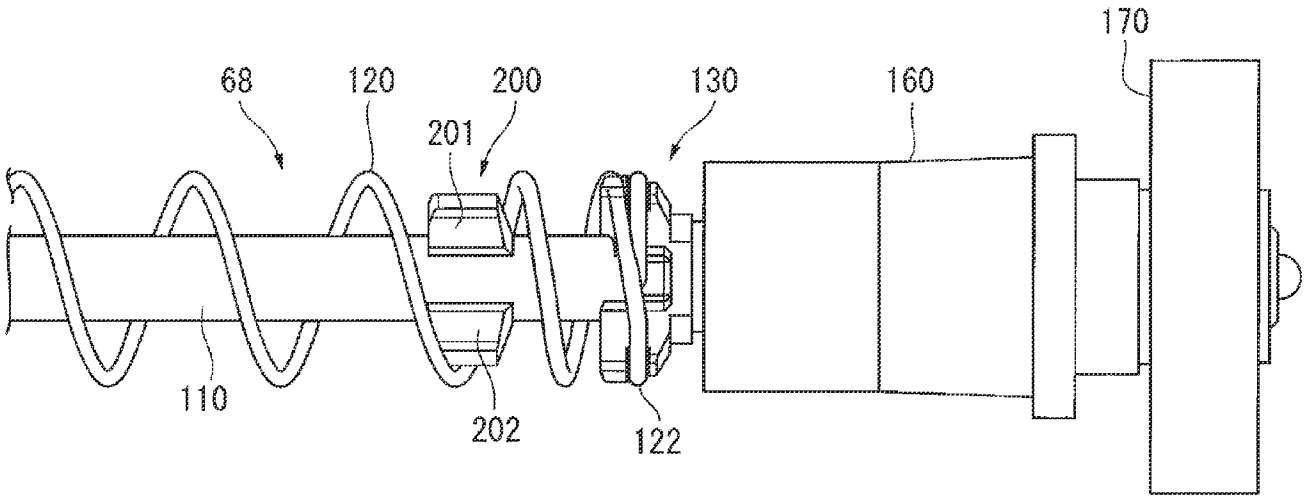
FIG. 24A is an explanatory view illustrating the configuration of an end portion of the toner transport member on the first holding structure side, which is used in Exemplary Embodiment 2.
Figure 24B:
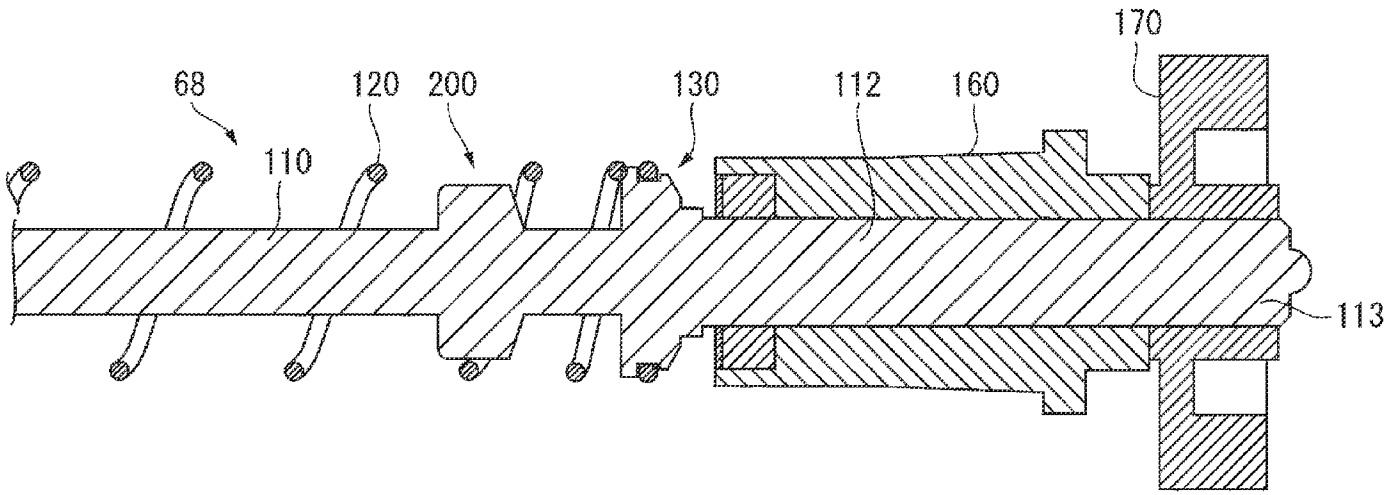
FIG. 24B is an explanatory view illustrating the cross-section thereof.

In the present exemplary embodiment, as illustrated in FIGS. 24A and 24B, after the spiral wire 120 is assembled with the rotation shaft 110, the bearing member 160 may be mounted on the support shaft portion 112 at one end portion of the rotation shaft 110, and the drive transmission gear 170 may be fitted onto the D-cut portion 113 formed at the tip end of the support shaft portion 112.

Figure 25A:
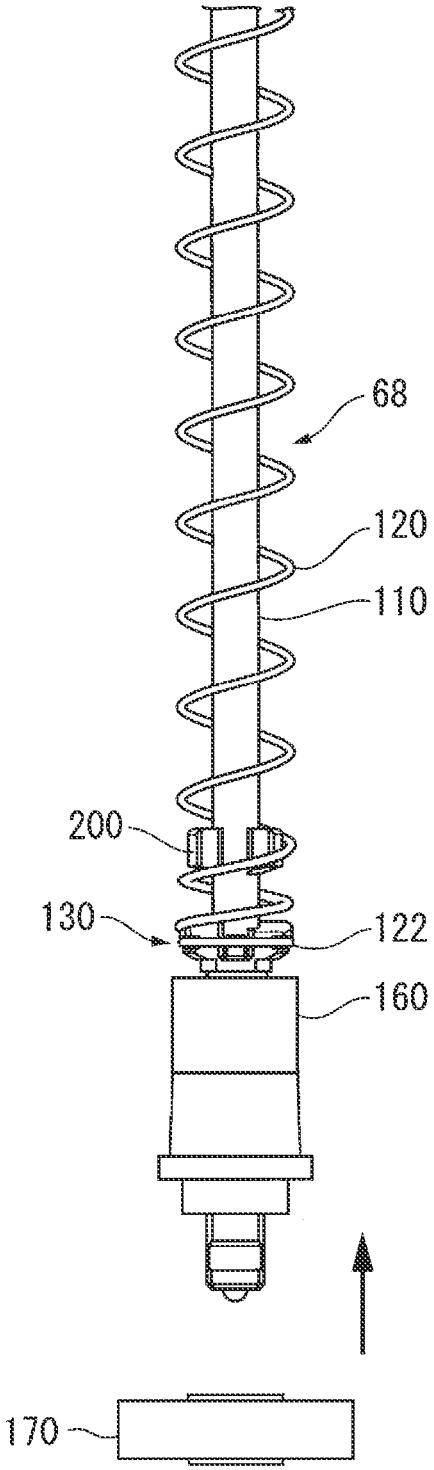
FIG. 25A is an explanatory view illustrating a state before a drive transmission gear is mounted in the toner transport member used in Exemplary Embodiment 2.

As illustrated in FIG. 25A, in a case where the drive transmission gear 170 is fitted onto the D-cut portion 113 of the rotation shaft 110, it is necessary for an operator to grip and fix the rotation shaft 110 and, in this state, to fit the drive transmission gear 170 onto the D-cut portion 113 of the rotation shaft 110 while pressing the drive transmission gear 170.

Figure 25B:
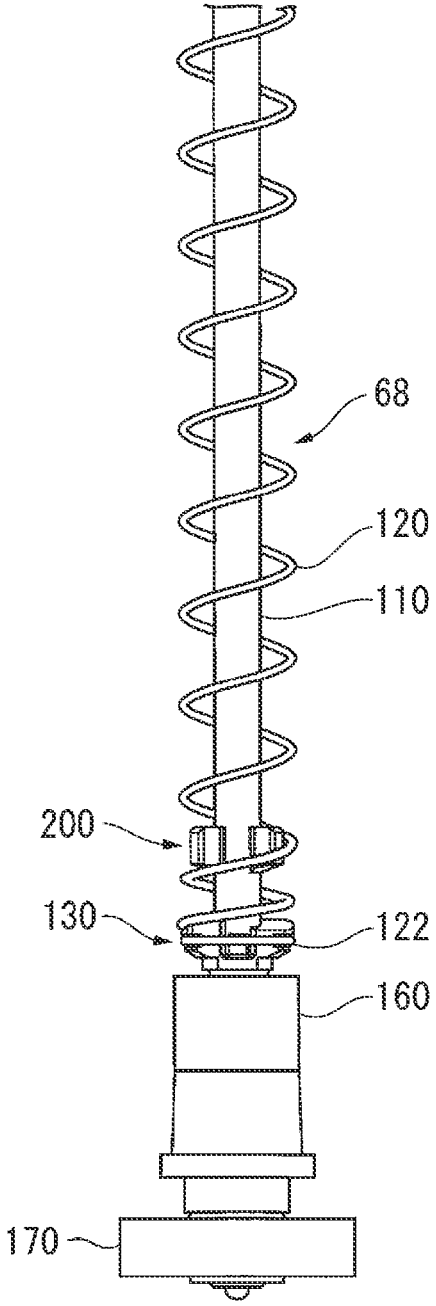
FIG. 25B is an explanatory view illustrating a state in which the mounting of the drive transmission gear in the toner transport member is completed.

In the present example, the toner transport member 68 includes a gripping protrusion 200 on the rotation shaft 110, and the gripping protrusion 200 is arranged not to be in contact with the spiral wire 120. Accordingly, as illustrated in FIGS. 25A and 25B, an operator may fix the toner transport member 68 by gripping the gripping protrusion 200 located at a position where the spiral wire 120 is not present and perform an operation of fitting the drive transmission gear 170 onto the D-cut portion 113 of the rotation shaft 110.

Comparative Form 4

Figure 26A:
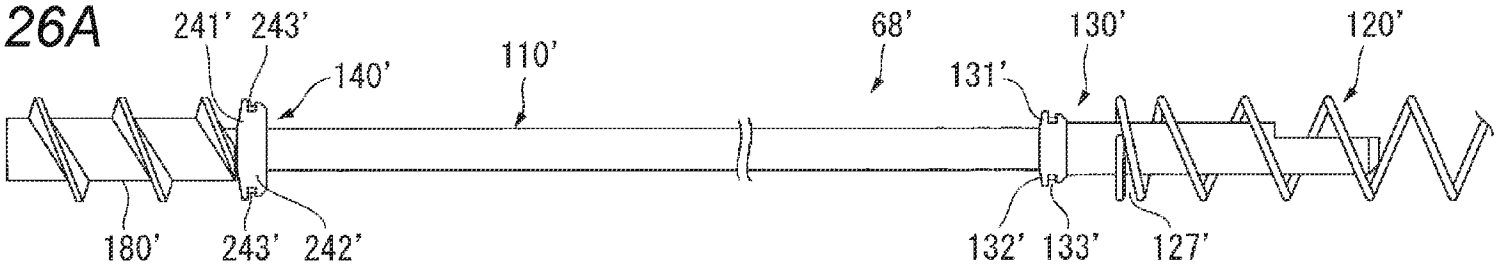
FIG. 26A is an explanatory view illustrating a holding structure of a spiral wire with respect to a rotation shaft of a toner transport member used in Comparative Form 4.

FIG. 26A illustrates a main part of a toner transport member according to Comparative Form 4.

In the drawing, the toner transport member 68' includes a rotation shaft 110', a spiral wire 120', and first and second holding parts 130' and 140'.

In the present example, the rotation shaft 110' is substantially similar to the rotation shaft 110 according to Exemplary Embodiment 1, and the spiral wire 120' includes terminal end circular arc portions 122' and 127' at the opposite end portions thereof, and the outer diameter of one terminal end circular arc portion 122' is selected to be less than the outer diameter of the spiral wire 120'. In addition, while the first holding part 130' has a configuration similar to that of Exemplary Embodiment 1, the protrusion size of the protrusions 131' and 132' is selected to be small according to the terminal end circular arc portion 122' having a small diameter. In addition, substantially similar to the first holding part 130', the second holding part 140' includes, in order to hold the terminal end circular arc portion 127', protrusions 241' and 242' of a paired configuration at symmetrical positions with the center of the rotation shaft 110' being interposed therebetween, and a concave portion 243' formed at the protruding end portion of each of the protrusions 241' and 242'.

Figure 26B:
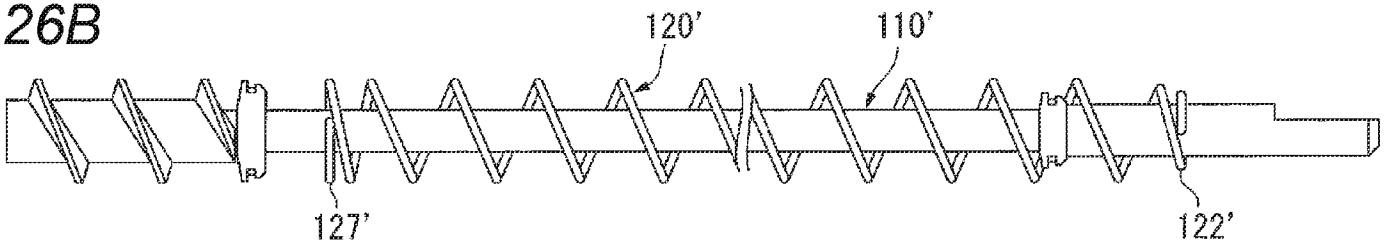
FIG. 26B is an explanatory view illustrating a state immediately before holding the spiral wire with respect to the rotation shaft in the toner transport member.
Figure 26C:
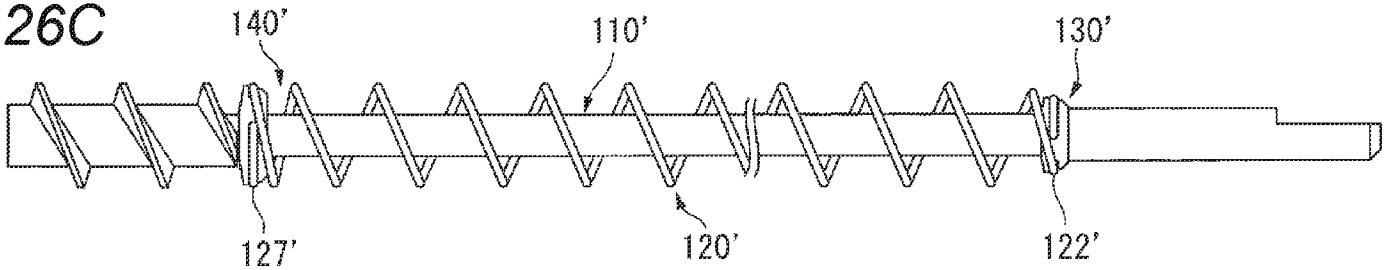
FIG. 26C is an explanatory view illustrating a state in which the holding of the spiral wire with respect to the rotation shaft is completed in the toner transport member.

According to this comparative form, in a case where the spiral wire 120' is inserted from one end portion of the rotation shaft 110', the insertion side of the spiral wire 120' may climb over the first holding part 130' since the first holding part 130' is provided in a small diameter even though the insertion side of the spiral wire 120' is the terminal end circular arc portion 127'. Thereafter, as illustrated in FIGS. 26B and 26C, the terminal end circular arc portion 127' of the spiral wire 120' may be stopped in the concave portions 243' of the protrusions 241' and 242' of the second holding part 140', and the terminal end circular arc portion 122' of the spiral wire 120' may be stopped in the concave portions 133' of the protrusions 131' and 132' of the first holding part 130'

However, in the present comparative form, in the holding structure using the first holding part 130', the outer diameter of the terminal end circular arc portion 122' is small, and the first holding part 130' has a small diameter so that it is difficult for the terminal end circular arc portion 122' to be stopped in the first holding part 130'. In addition, the outer diameter of the spiral wire 120' is reduced on the periphery of the first holding part 130' so that there is a concern that toner may not be transported. In addition, in the holding structure using the second holding part 140', since the terminal end circular arc portion 127' of the spiral wire 120' is held by the second holding part 140', a toner transport force is decreased in the vicinity of the second holding part 140'. Accordingly, even if the spiral blade 180' is formed integrally with the rotation shaft 110' to be continuous from the spiral wire 120', there is a concern that defective transport of toner may be caused from the spiral wire 120' to the spiral blade 180'.

Comparative Form 5

Figure 27A:
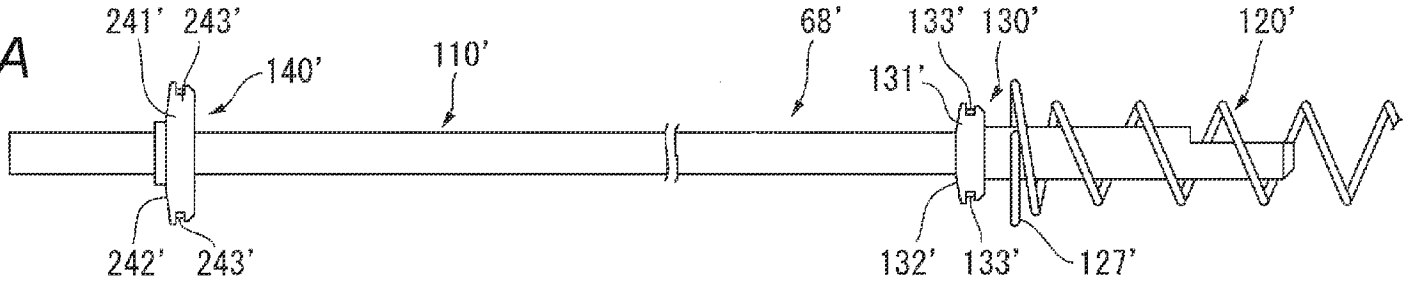
FIG. 27A is an explanatory view illustrating a holding structure of a spiral wire with respect to a rotation shaft of a toner transport member used in Comparative Form 5.

FIG. 27A illustrates a main part of a toner transport member according to Comparative Form 5.

In the drawing, similar to Comparative Form 4, the toner transport member 68' includes a rotation shaft 110', a spiral wire 120', and first and second holding parts 130' and 140', but has a configuration different from that of Comparative Form 4.

In other words, the rotation shaft 110' does not include the spiral blade 180, and only the spiral wire 120' is held. In addition, while terminal end circular arc portions 122' and 127' are provided at the opposite ends of the spiral wire 120', the circular arc portions 122' and 127' are different from those of Comparative Form 4. The outer diameter of the terminal end circular arc portion 122' is the same as the outer diameter of the spiral portion of the spiral wire 120', but the outer diameter of the terminal end circular arc portion 127' is larger than the outer diameter of the spiral portion of the spiral wire 120'. In addition, the first holding part 130' and the second holding part 140' are configured to hold the terminal end circular arc portions 122' and 127' formed at opposite ends of the spiral wire 120'.

Figure 27B:
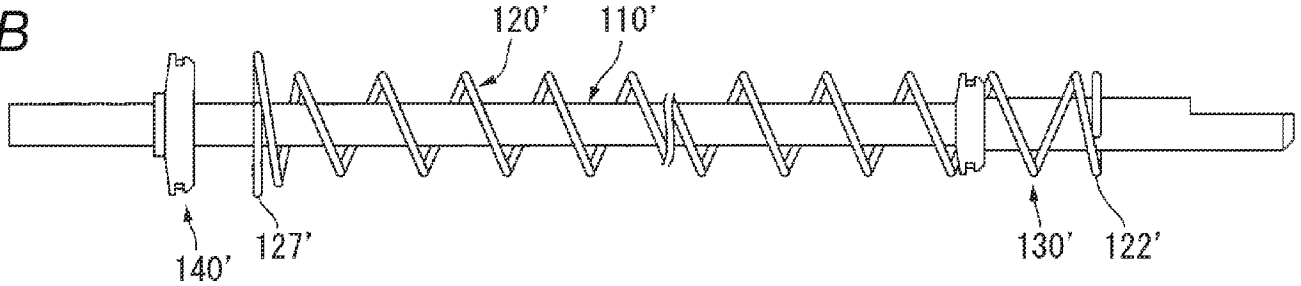
FIG. 27B is an explanatory view illustrating a state immediately before holding the spiral wire with respect to the rotation shaft in the toner transport member.
Figure 27C:
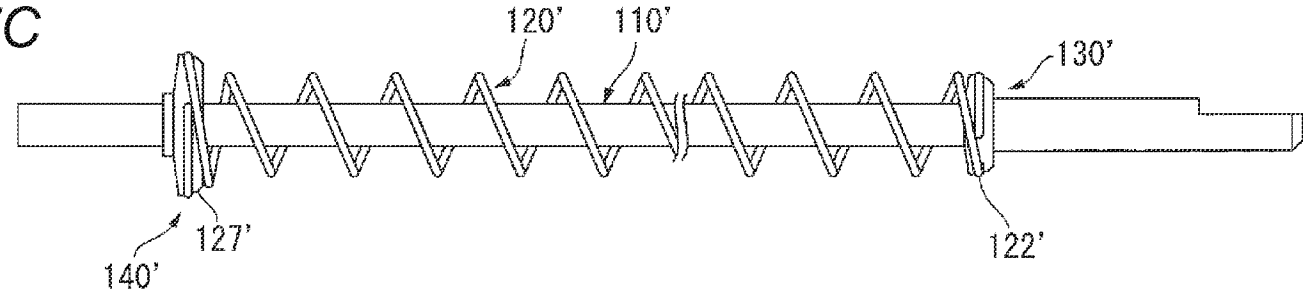
FIG. 27C is an explanatory view illustrating a state in which the holding of the spiral wire with respect to the rotation shaft is completed in the toner transport member.

According to the present comparative form, in a case where the spiral wire 120' is inserted from one end portion of the rotation shaft 110', the spiral wire 120' may climb over the first holding part 130' since the outer diameter of the terminal end circular arc portion 127' is formed to be large compared to that of the first holding part 130' even though the insertion side of the spiral wire 120' is the terminal end circular arc portion 127'. Thereafter, as illustrated in FIGS. 27B and 27C, the terminal end circular arc portion 127' of the spiral wire 120' may be stopped in the concave portions 243' of the protrusions 241' and 242' of the second holding part 140', and the terminal end circular arc portion 122' of the spiral wire 120' may be stopped in the concave portions 133' of the protrusions 131' and 132' of the first holding part 130'

However, in the present comparative form, since the holding structure using the second holding part 140' has a large diameter, even if the toner is transported using the spiral wire 120', the toner is come in contact with the second holding part 140' so that it is difficult to transport the toner. For this reason, in the present example, it is difficult to employ, for example, a design in which the spiral blade 180' is provided on the end portion of the rotation shaft 110'.

EXAMPLES

Example 1

The present example implements the toner transport member 68 used in Exemplary Embodiment 1.

The specification of the present example is as follows.

Shaft diameter of rotation shaft: ϕ4 mm

Outer diameter of spiral wire: ϕ 10 mm

Pitch of spiral wire: 8 mm

Wire diameter of spiral wire: ϕ 0.8 mm

Inter-wire distance of spiral wire: 7.2 mm

Width size of protruding end portion of protrusion of first holding part: 3 mm

Width size of protruding end portion of protrusion of second holding part: 3 mm

Example 2

The present example implements the toner transport member 68 used in Exemplary Embodiment 2.

The specification of the present example includes the gripping protrusion that is selected as follows, in addition to the specification of Example 1.

Position of gripping protrusion: position spaced apart from protrusion of first holding part by one pitch of spiral wire Width size of protruding end portion of gripping protrusion: 3 mm For Examples 1 and 2, an assembly operation is performed by inserting a spiral wire from one end of a rotation shaft. In both of Examples 1 and 2, causing the spiral wire to advance along the rotation shaft while moving the spiral wire up and down and holding the opposite ends of the spiral wire t using the second holding part and the first holding part may be simply performed.

In particular, in Example 2, while the gripping protrusion is added, it has been confirmed that the gripping protrusion may not obstruct the assembly of the spiral wire with the rotation shaft.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder transport member comprising:

a rotation shaft that is rotationally driven;

a spiral wire that is wound in a spiral shape in a diameter larger than an outer diameter of the rotation shaft at a predetermined pitch interval and that is formed to be insertable from one end side of the rotation shaft; and holding parts that are disposed near opposite ends of the rotation shaft respectively and that hold opposite end portions of the spiral wire in a rotation-prevented state, wherein one end portion of the spiral wire comprises a terminal end circular arc portion formed in a circular arc shape, and a bent portion bent to a center side of the rotation shaft is formed at a tip end of the terminal end circular arc portion, and wherein the holding part that holds the one end portion of the spiral wire comprises a pair of protrusions at symmetrical positions with a center of the rotation shaft being interposed therebetween, a concave portion configured to accommodate an inner peripheral surface of the terminal end circular arc portion is formed at a protruding end portion of each of the protrusions, and a size of the protruding end portion of the protrusion in a direction of the rotation shaft is less than ½ of an inter-wire distance obtained by subtracting a wire diameter of the spiral wire from a pitch of the spiral wire.

2. The powder transport member according to claim 1, wherein the terminal end circular arc portion has an inner diameter that is substantially same as an inner diameter of a spiral portion of the spiral wire.

3. The powder transport member according to claim 1, wherein the concave portion of the protrusion has a depth size of ½ or more of the wire diameter of the spiral wire.

4. The powder transport member according to claim 1, wherein the protruding end portion of the protrusion comprises a stepped portion which has a lower height at an entrance side from which the terminal end circular arc portion is entered toward the concave portion than a height at an opposite side of the entrance side.

5. The powder transport member according to claim 1, wherein the protruding end portion of the protrusion comprises an inclined portion that is inclined such that a protrusion size gradually increases toward the concave portion at an entrance side from which the terminal end circular arc portion is entered toward the concave portion.

6. The powder transport member according to claim 1, wherein the bent portion of the terminal end circular arc portion is in contact with or in proximity to one of the protrusions when the rotation shaft is driven to be rotated.

7. The powder transport member according to claim 1, wherein, the holding part configured to hold one end of the spiral wire has a hooking portion configured to hook the bent portion of the terminal end circular arc portion, at a portion positioned between the protrusions in a peripheral direction of the rotation shaft.

8. The powder transport member according to claim 1, wherein other end portion of the spiral wire comprises a terminal end spiral portion opened at a terminal end, and a bent portion bent to the center side of the rotation shaft is formed at the terminal end of the terminal end spiral portion, and wherein the holding part configured to hold the other end portion of the spiral wire comprises three protrusions at the pitch interval of the spiral wire and at an interval of half circumference of the rotation shaft, a concave portion configured to accommodate an inner peripheral surface of the terminal end spiral portion is formed at a protruding end potion of each of the three protrusions, and a hooking portion configure to hook the bent portion of the terminal end spiral portion is formed at the rotation shaft.

9. The powder transport member according to claim 8, wherein the concave portions of the three protrusions have a depth size of ½ or more of the wire diameter of the spiral wire.

10. The powder transport member according to claim 8, wherein the rotation shaft and the holding parts are integrally molded from a resin, and the spiral wire is made from a metal.

11. The powder transport member according to claim 8, wherein the rotation shaft comprises a spiral blade made from a resin at a portion adjacent to the holding part configured to hold the other end portion of the spiral wire.

12. The powder transport member according to claim 11, wherein a groove is formed at the spiral blade made from the resin as a hooking portion configured to hook the bent portion of the terminal end spiral portion.

13. The powder transport member according to claim 1, wherein a drive transmission member that transmits a driving force is mounted at an end portion of the rotation shaft disposed at the side of the holding part holding one end portion of the spiral wire.

14. The powder transport member according to claim 13, wherein, in addition to the pair of protrusions as the holding part configured to hold one end portion of the spiral wire, the rotation shaft has a gripping protrusion that has a diameter smaller than the holding part and is arranged not to be in contact with the spiral wire.

15. A powder transport apparatus comprising:

a powder container housing powder;

the powder transport member according to claim 1 which is arranged inside the powder container; and a driving system that rotationally drives the rotation shaft of the powder transport member.

16. A powder processing apparatus comprising:

a powder processor performing processing with powder; and the powder transport apparatus according to claim 15 that transports an excess portion of the powder processed by the powder processor or powder to be processed by the powder processor.

17. The powder processing apparatus according to claim 16, comprising:

a powder collector that collects the excess portion of the powder processed by the powder processor;

the powder transport apparatus that transports powder collected by the powder collector; and a powder returning mechanism that returns the powder transported by the powder transport apparatus to the powder processor.

* * * * *